US010081936B2

(12) United States Patent
Okubo et al.

(10) Patent No.: US 10,081,936 B2
(45) Date of Patent: Sep. 25, 2018

(54) FLUSH TOILET APPARATUS AND DRIVE UNIT FOR SAME

(71) Applicant: TOTO LTD., Fukuoka (JP)

(72) Inventors: Mayu Okubo, Fukuoka (JP); Yoshitaka Tsuru, Fukuoka (JP)

(73) Assignee: TOTO LTD., Fukuoka (JP)

( * ) Notice: Subject to any disclaimer, the term of this patent is extended or adjusted under 35 U.S.C. 154(b) by 386 days.

(21) Appl. No.: 14/820,057

(22) Filed: Aug. 6, 2015

(65) Prior Publication Data

US 2016/0069057 A1 Mar. 10, 2016

(30) Foreign Application Priority Data

Sep. 8, 2014 (JP) ..... 2014-182512

(51) Int. Cl.

| | |
|---|---|
| ***E03D 5/10*** | (2006.01) |
| ***E03D 5/00*** | (2006.01) |
| ***E03D 5/09*** | (2006.01) |
| ***E03D 1/34*** | (2006.01) |

(52) U.S. Cl.
CPC *E03D 1/34* (2013.01); *E03D 5/10* (2013.01)

(58) Field of Classification Search
CPC ..... E03D 5/10
USPC ..... 4/405–406, 411
See application file for complete search history.

(56) References Cited

U.S. PATENT DOCUMENTS

| | | | | |
|---|---|---|---|---|
| 6,968,579 | B1 | 11/2005 | Feinberg et al. | |
| 2005/0273917 | A1* | 12/2005 | Lapossy | E03D 9/05 4/213 |
| 2006/0037127 | A1* | 2/2006 | Chen | E03D 9/05 4/213 |
| 2006/0053939 | A1 | 3/2006 | Basile et al. | |

(Continued)

FOREIGN PATENT DOCUMENTS

| | | | |
|---|---|---|---|
| CN | 2453059 | Y | 10/2001 |
| CN | 203049740 | U | 7/2013 |

(Continued)

OTHER PUBLICATIONS

An Office Action issued by the State Intellectual Property Office of the People's Republic of China dated Dec. 5, 2016, which corresponds to Chinese Patent Application No. 201510561279.5 and is related to U.S. Appl. No. 14/820,057; with English language comments.

*Primary Examiner* — Christine Skubinna
(74) *Attorney, Agent, or Firm* — Studebaker & Brackett PC

(57) ABSTRACT

A flush toilet apparatus includes: a toilet main body portion, a reservoir tank portion, a discharge valve apparatus including a valve body for opening and closing a discharge opening in the reservoir tank portion, and an automatic flush drive unit for driving the discharge valve apparatus portion to open and close the valve body; wherein the drive unit includes a drive unit main body portion including an actuator for electrically driving the discharge valve apparatus portion, and an elongated operating member for connecting (Continued)

a discharge valve apparatus portion and a drive unit main body portion and operating the opening and closing action of a valve body by driving an electrically powered drive portion; and wherein the toilet main body includes an attaching portion disposed on the back surface side thereof, to which the drive unit main body portion is attached.

11 Claims, 16 Drawing Sheets

(56) References Cited

U.S. PATENT DOCUMENTS

| | | | | |
|---|---|---|---|---|
| 2009/0100958 | A1 | 4/2009 | Basile et al. | |
| 2014/0123378 | A1* | 5/2014 | Luettgen ..... | B23P 19/00 4/406 |

FOREIGN PATENT DOCUMENTS

| | | |
|---|---|---|
| JP | S63-022477 U | 2/1988 |
| JP | 2006-038225 | 2/2006 |

* cited by examiner

FLUSH TOILET APPARATUS AND DRIVE UNIT FOR SAME

FIELD OF THE INVENTION

The present invention relates to a flush toilet apparatus and drive unit for same, and more particularly relates to a flush toilet apparatus for flushing a toilet with flush water to discharge waste, and to a drive unit for same.

BACKGROUND OF THE INVENTION

Conventionally known flush toilet apparatuses have included those including what is known as a direct-drive discharge valve apparatus, such as set forth in CN 203049740 U (Patent Document 1), wherein a discharge opening is opened and closed by the up and down movement of a discharge valve body relative to a discharge opening in a reservoir tank portion for storing flush water supplied to a toilet main body portion.

A conventional flush toilet apparatus such as that set forth in Patent Document 1 includes an automatic flush drive unit inside a reservoir tank portion for electrically driving a discharge valve apparatus based on a signal from a sensor or the like detecting the presence of a toilet user; when the automatic flush drive unit is driven, the discharge valve body rises by a predetermined pull-up amount and the discharge opening is opened for a predetermined time. After flush water has been supplied to the toilet main body portion from a reservoir tank portion, the raised state of the discharge valve body is released, and the discharge opening is shut-off by the discharge valve body.

In recent years, on the other hand, with greater design diversity the need has increased for what are known as one-piece flush toilets, in which the reservoir tank portion for storing flush water used for toilet flushing is integrally formed of porcelain.

In such one-piece flush toilets, reservoir tank portions of what is known as the low-silhouette type are frequently adopted, in which the up-down vertical width dimension of the reservoir tank portion is set to be short relative to the left-right horizontal width direction thereof in order to reduce vertical installation space and to assure design characteristics such as external appearance and aesthetics of the toilet, and there is also an increased need to reduce the size of the reservoir tank portion itself.

BRIEF SUMMARY OF THE INVENTION

Technical Problem

In the low-silhouette type of reservoir tank portion in the above-described one-piece flush toilet, however, the up-down vertical width dimension is short relative to the left-right horizontal width dimension, and in particular space in the height direction is limited, and because significant space is required for the multiple related apparatuses such as the water supply apparatus and discharge valve apparatus disposed inside the reservoir tank portion, internal space becomes quite limited as the reservoir tank portion is made more compact.

This tight internal space limitation inside the reservoir tank portion thus makes it difficult to install an automatic flush drive unit for driving a direct-drive discharge valve apparatus inside the reservoir tank portion, hence it must be disposed outside the reservoir tank portion. If it is placed outside the reservoir tank portion, the problem also arises that toilet aesthetic appeal is compromised if the automatic flush drive unit is disposed on the exterior of the reservoir tank portion where it is visible from the exterior of the toilet.

Also, when this type of automatic flush drive unit is installed outside a reservoir tank portion it can be anticipated, particularly as a simple means for raising the discharge valve body of a direct-drive discharge valve body, that by employing a tube affixed at one end to a drive unit and at the other end to part of a discharge valve body, and an operating wire which is slidably inserted into this tube, connected at one end to the mechanism portion of the drive unit and connected at the other end to the discharge valve body, the amount by which an actuator rotates as a result of electrically driving a drive unit will be converted to an operating wire member uptake amount, and will also be converted to an amount of lifting of the discharge valve body by the operating wire member.

However, when the automatic flush drive unit is installed outside the reservoir tank portion, the length of the pathway between the discharge valve apparatus and the drive unit increases, and the tube and wire length increase compared to the case when the automatic flush drive unit is installed inside the reservoir tank portion. Therefore in the case of a direct-drive discharge valve apparatus, particularly, the stroke amount by which the discharge valve body rises and falls, or the operating amounts such as the amount the discharge valve body is pulled up when raised by the wire at the start of a discharge opening, are quite small compared to the pathway length between the discharge valve apparatus and the drive unit, or the tube and wire length, therefore to the extent the pathway length between the discharge valve apparatus and the drive unit or the tube and wire length increase, these tolerances or variability in length and sliding resistance between the tube and the wire, etc. have a large influence due to the required amount of operation of the discharge valve body, resulting in problems with variability of discharge valve body operation and faults with the discharge valve body opening and closing action, making appropriate operation difficult.

The present invention was thus undertaken to solve the above-described problems with the conventional art, and has the object of providing a flush toilet apparatus and drive unit for this flush toilet apparatus capable of constraining variability in the amount of the operation for opening and closing a valve body in a discharge valve apparatus portion, and of appropriately opening and closing a valve body.

Solution to Problem

To accomplish the above object, the present invention is a drive unit for a flush toilet apparatus for flushing a toilet using flush water to discharge waste, including: a toilet main body portion including a bowl portion for receiving waste; a reservoir tank portion placed at the rear side on this toilet main body portion for storing flush water supplied to the toilet main body portion; a direct-drive discharge valve apparatus portion placed inside this reservoir tank portion and including a valve body for opening and closing a discharge opening on the reservoir tank portion by up and down motion; and a drive unit portion for driving this discharge valve apparatus portion to open and close the valve body; wherein this drive unit portion includes a drive unit main body portion including an electrically powered drive portion for electrically driving the discharge valve apparatus portion; and an elongated operating member, connected to the discharge valve apparatus portion and the drive unit main body portion, for operating the opening and closing of the valve body by driving the electrically powered drive portion; and wherein an attaching portion, to which the drive unit main body portion is attached, is provided on the back surface side of the toilet main body portion or the bottom surface side of the reservoir tank portion, and the drive unit main body portion is disposed vertically below or in the vicinity of the discharge valve apparatus while attached to the attaching portion, so that slack over the entire length of the operating member is constrained.

In the first invention of the present invention thus constituted, with respect to the drive unit portion for driving the discharge valve apparatus portion, placed at the rear side on top of the toilet main body portion inside the reservoir tank portion, when in a state such that that drive unit main body portion is attached to the attaching portion provided on the back surface side of the toilet main body portion or the bottom surface side of the reservoir tank portion, the drive unit main body portion is disposed on the back surface side of the toilet main body portion or the bottom surface side of the reservoir tank portion, and is also disposed vertically below or in the vicinity of the discharge valve apparatus portion, therefore slack over the entire length of the elongated operating member in the drive unit portion can be constrained. Therefore unnecessary bending of the operating member caused by excessive total length of the drive unit portion operating member between the discharge valve apparatus portion inside the reservoir tank portion and the drive unit main body portion can be constrained, so the operating member can accurately operate the opening and closing action of the valve body by driving the electrically powered drive portion of the drive unit main body portion, and variability in the amount of that operation can be constrained. A flush toilet apparatus capable of appropriately opening and closing a valve body in a discharge valve apparatus portion can thus be provided.

The first invention of the present invention furthermore preferably has an affixing member for affixing the drive unit main body portion to a toilet main body portion attaching portion, in accordance with toilet main body portion or reservoir tank portion type, in an orientation such that slack over the entire length of the operating member is constrained.

The first invention of the present invention thus constituted, having an affixing member for affixing the drive unit main body portion to a toilet main body portion attaching portion in accordance with toilet main body portion or reservoir tank portion type, in an orientation such that slack over the entire length of the operating member is constrained, enables reliable affixing of the drive unit main body portion to the toilet main body portion attaching portion through this affixing member in an orientation such that slack over the entire length of the operating member is constrained. Therefore since drive force from the electrically powered drive portion of the drive unit main body portion affixed to the affixing member can be efficiently and reliably transferred, the valve body in the discharge valve apparatus portion can be accurately moved relative to the discharge opening, and the valve body appropriately opened and closed.

In the first invention of the present invention, the reservoir tank portion preferably includes: a reservoir portion in which flush water is stored, open at the top, with the discharge valve apparatus portion placed within it; and a lid body disposed at the top end of this reservoir portion; wherein the reservoir portion forms a rear wall portion adjacent to the rear side of the discharge valve apparatus portion, and a hole or channel is formed on the rear wall portion or lid body above the shut-off water level inside the reservoir tank portion so that the operating member can be inserted through the inside and outside of the reservoir tank portion.

In the first invention of the present invention thus constituted, the reservoir tank portion includes a reservoir portion for storing flush water, open at the top, with a discharge apparatus disposed there within, and a lid body disposed at the top end of this reservoir portion; wherein the reservoir portion is adjacent to the rear side of the discharge valve apparatus and forms a rear wall portion, and by forming a hole or channel into which the operating member can be inserted on the inside and outside of the reservoir tank portion in the rear wall portion or the lid body of the reservoir portion above the water shutoff level inside the reservoir portion, slack over the entire length of the operating member between the discharge valve apparatus and the drive unit main body portion can be constrained while assuring operability, so that unnecessary bending and the like of the operating member caused by excessive total length of the operating member between the discharge valve apparatus portion and the drive unit main body portion can be constrained. Therefore variability in the amount of operation required when the operation member operates the opening and closing action of a valve body in a discharge valve apparatus can be constrained when the electrically powered drive portion of the drive unit portion is driven, and the valve body can be appropriately opened and closed.

In the first invention of the present invention, the operating member is preferably arranged such that the part thereof which is connected to the drive unit main body portion after passing through an insertable hole or channel at the rear wall portion of the reservoir portion is connected essentially perpendicularly to the drive unit main body portion.

In the first embodiment of the present invention, with regard to the operating member, the total length of the operating member is shortened by connecting the part connected to the drive unit main body portion to the drive unit main body portion in an essentially perpendicular manner relative to the drive unit main body portion after passing through the insertable hole or channel in the rear wall portion of reservoir portion of the reservoir tank portion, therefore unnecessary bending and the like of the operating member caused by excessive length of the operating member between the discharge valve apparatus portion and the drive unit main body portion can be constrained. Therefore variability in the amount of operation used when the operating member operates the opening and closing action of a valve body in a discharge valve apparatus at the time the electrically powered drive portion of the drive unit portion is driven can be constrained, and the valve body can be appropriately opened and closed.

In a first invention of the present invention, the operating member preferably includes a first operating member connected at one end to the discharge valve apparatus portion and a second operating member connected at one end to the drive unit main body portion; wherein the drive unit portion further includes a connecting means for connecting the other end of the first operating member and the other end of the second operating member in a state wherein the respective lengths of the first operating member and the second operating member are adjusted in response to usage conditions.

In the invention thus constituted, the operating member includes a first operating member connected at one end to a discharge valve apparatus, and a second operating member connected at one end to a drive unit main body portion, and the drive unit portion further includes a connecting means for connecting the other end of the first operating member and the other end of the second operating member in a state wherein the usage respective lengths of the first operating member and the second operating member are adjusted according to usage conditions, so that the total length of the first operating member and the second connecting member can be appropriately shortened according to usage conditions, such that unnecessary bending and the like of the first connecting member and the second connecting member caused by excessive total length of the first operating member and the second connecting member between the discharge valve apparatus portion and the drive unit main body portion can constrained. Therefore variability in the amount of operation required when the operating member operates the opening and closing action of a valve body in a discharge valve apparatus during driving of the electrically powered drive portion of the drive unit portion can be constrained, and the valve body can be appropriately opened and closed.

In a first invention of the invention, the operating member preferably includes: a tube portion affixed at one end to the discharge valve apparatus portion and affixed at the other end to the drive unit main body portion, and a wire portion inserted into this tube portion, with one end connected to the power drive portion and the other end connected to the valve body, so as to slide relative to the tube portion as a result of driving the power drive portion.

In the invention thus constituted, the operating member includes a tube portion, one end of which is affixed to a drive unit main body portion, and a wire portion inserted into this tube portion, one end of which is connected to the electrically powered drive portion and the other end of which is connected to the valve body and slides on the tube portion as a result of being driven by the electrically powered drive portion, such that the operating member wire portion is protected by the tube portion, and durability of the wire portion can be improved. By constraining slack over the entire length of the operating member, sliding resistance can be reduced between the tube portion and the wire portion when the electrically powered drive portion of the drive unit portion drives the operating member wire portion to slide along the tube portion, therefore when the operating member wire portion slides, the valve body can be more accurately moved relative to the discharge opening, and the opening and closing action of the valve body can be more appropriately performed.

In the first invention of the present invention, the electrically powered drive portion in the drive unit main body portion preferably includes an electrically powered drive source and a rotary mechanism portion rotated by this electrically powered drive source; the wire portion of the operating member moves in the rotation tangent direction of the rotary mechanism portion when the electrically powered drive portion is driven, so that one end is connected to the rotary mechanism portion to enable opening and closing of the valve body.

In the first invention thus constituted, the drive unit main body portion electrically powered drive portion includes an electrically powered drive source and a rotary mechanism portion rotated by this electrically powered drive source, and because one end of the operating member is connected to the rotary mechanism portion so as to move in the rotation tangent direction of the rotary mechanism portion during driving of the electrically powered drive portion, enabling the discharge valve apparatus valve body to be opened and closed, the total length of the operating member wire portion can be shortened, and unnecessary bending and the like of the wire portion caused by excessive total length of the wire portion between the discharge valve apparatus portion and the drive unit main body portion can be constrained. Therefore variability in the amount of operation required when the operating member operates the opening and closing of the discharge valve apparatus valve body during driving by the drive unit portion electrically powered drive portion can be constrained, and sliding resistance between the tube portion and the wire portion when the operating member wire portion is made to slide relative to the tube portion can be reduced, so the valve body can be more accurately moved relative to the discharge opening when the operating member wire portion is made to slide, and the valve body can be more appropriately opened and closed.

In the first embodiment of the present invention, the reservoir tank portion is preferably integrally formed at the rear side of the toilet main body portion.

In the first invention thus constituted, relative as well to what is known as a one-piece flush toilet, in which the reservoir tank portion is integrally formed on the rear side on the toilet main body, there is an attaching portion to which a drive unit main body portion is attached so that slack over the entire length of the operating member disposed at the bottom of the reservoir tank portion can be constrained; since the drive unit main body portion is disposed vertically below or in the vicinity of the discharge valve apparatus portion, unnecessary bending and the like of the operating member caused by excessive total length of the operating member between the discharge valve apparatus portion and the drive unit main body portion can be constrained. Therefore variability in the amount of operation used when the operating member operates the opening and closing action of a valve body in a discharge valve apparatus during driving by the electrically powered drive portion of the drive unit portion can be constrained, and the valve body can be appropriately opened and closed.

In the first invention of the present invention, the reservoir tank portion is preferably set so that its up-down vertical width dimension is shorter than its left-right horizontal width dimension.

In the invention thus constituted, relative as well to what is known as a low-silhouette reservoir tank portion, in which the up-down vertical width dimension is set to be shorter than its left-right horizontal width dimension, and the space inside the reservoir tank is relatively limited, there is an attaching portion to which a drive unit main body portion is attached so that slack over the entire length of the operating member disposed at the bottom of the reservoir tank portion can be constrained; since the drive unit main body portion is disposed vertically below or in the vicinity of the discharge valve apparatus portion, unnecessary bending and the like of the operating member caused by excessive total length of the operating member between the discharge valve apparatus portion and the drive unit main body portion can be constrained. Therefore variability in the amount of operation used when the operating member operates the opening and closing action of a valve body in a discharge valve apparatus when the electrically powered drive portion of the drive unit portion is driven can be constrained, and the valve body can be appropriately opened and closed.

Next, the second invention of the present invention is a drive unit for a flush toilet apparatus for flushing a toilet using flush water to discharge waste, having: a drive unit main body portion attached to a flush toilet apparatus, including a toilet main body portion including a bowl portion for receiving waste, a reservoir tank portion placed at the rear side on this toilet main body portion for storing flush water supplied to the toilet main body portion, and a direct-drive discharge valve apparatus portion placed inside this reservoir tank portion and including a valve body for opening and closing a discharge opening on the reservoir tank portion by up and down movement; an electrically powered drive portion disposed on this drive unit main body portion for power-driving the discharge valve apparatus portion; and an elongated operating member for connecting the discharge valve apparatus and the drive unit main body portion and operating the opening and closing action of the valve body driven by the electrically powered drive portion; wherein an attaching portion is provided on the back surface side of the toilet main body portion or the bottom surface side of the reservoir tank portion, on which the drive unit main body portion is attached, and the drive unit main body portion is disposed vertically below the discharge valve apparatus portion or in the vicinity thereof, so that when attached to the attaching portion, slack over the entire length of the operating member of the operating member is constrained.

In a second invention of the present invention thus constituted, in a state wherein the direct-drive type drive unit main body portion for driving the discharge valve apparatus portion, located inside the reservoir tank placed at the rear side on the toilet main body of the flush toilet apparatus, is attached to an attaching portion placed on the back surface side of the toilet main body portion or on the bottom surface side of the reservoir tank portion, the drive unit main body portion is disposed on the back surface side or the bottom surface side of the flush toilet apparatus, and is disposed vertically below or in the vicinity of the discharge valve apparatus portion, therefore slack over the entire length of the elongated operating member in the drive unit portion can be constrained. Hence, unnecessary bending of the operating member caused by excessive total length of the operating member between the discharge valve apparatus portion inside the reservoir tank portion and the drive unit main body portion can be constrained, so the operating member can accurately operate the opening and closing action of the discharge valve apparatus valve body by driving the electrically driven portion of the drive unit main body portion, and variability in the amount of that operation can be constrained. A drive unit for a flush toilet apparatus capable of appropriately opening and closing a valve body in a discharge valve apparatus portion can thus be provided.

The second invention of the present invention furthermore preferably has an affixing member for affixing the drive unit main body portion to a toilet main body portion attaching portion, in accordance with toilet main body portion or reservoir tank portion type, in an orientation such that slack over the entire length of the operating member is constrained.

In the second invention of the present invention thus constituted, having an affixing member for affixing the drive unit main body portion to a toilet main body portion attaching portion, in accordance with the type of toilet main body portion or reservoir tank, in an orientation such that slack over the entire length of the operating member is constrained, enables reliable affixing of the drive unit main body portion to the toilet main body portion attaching portion through this affixing member in an orientation such that slack over the entire length of the operating member is constrained. Therefore since the drive force from the electrically powered drive portion of the drive unit main body portion affixed to the affixing member can be efficiently and reliably transferred, the valve body in the discharge valve apparatus portion can be accurately moved relative to the discharge opening, and the valve body appropriately opened and closed.

In a second invention of the present invention, the operating member preferably has: a first operating member connected at one end to the discharge valve apparatus portion and a second operating member connected at one end to the drive unit main body portion; wherein the drive unit portion further includes a connecting means for connecting the other end of the first operating member and the other end of the second operating member in a state wherein the respective lengths of the first operating member and the second operating member are adjusted in response to usage conditions.

In the second invention thus constituted, the operating member includes a first operating member connected at one end to a discharge valve apparatus, and a second operating member connected at one end to a drive unit main body portion, and the drive unit further has a connecting means for connecting the other end of the first operating member and the other end of the second operating member in a state wherein the usage respective lengths of the first operating member and the second operating member are adjusted according to usage conditions, so that the total length of the first operating member and the second connecting member can be appropriately shortened according to usage conditions, such that unnecessary bending and the like of the first connecting member and the second connecting member caused by excessive total length of the first operating member and the second connecting member between the discharge valve apparatus portion and the drive unit main body portion can constrained. Therefore variability in the amount of operation used when the operation member operates the opening and closing action of a valve body in a discharge valve apparatus at the time when the electrically powered drive portion is driven can be constrained, and the valve body can be appropriately opened and closed.

In the second invention of the present invention, the operating member preferably includes: a tube portion affixed at one end to the discharge valve apparatus portion and affixed at the other end to the drive unit main body portion, and a wire portion inserted into this tube portion, with one end connected to the power drive portion and the other end connected to the valve body, so as to slide relative to the tube portion as a result of driving the power drive portion.

In the second invention thus constituted, the operating member includes a tube portion, one end of which is affixed to a drive unit main body portion, and a wire portion inserted into this tube portion, one end of which is connected to the electrically powered drive portion and the other end of which is connected to the valve body and slides on the tube portion as a result of being driven by the electrically powered drive portion, such that the operating member wire portion is protected by the tube portion, and durability of the wire portion can be improved. By constraining slack over the entire length of the operating member, sliding resistance can be reduced between the tube portion and the wire portion when the electrically powered drive portion drives the operating member wire portion to slide along the tube portion, therefore when the operating member wire portion slides, the valve body can be more accurately moved relative to the discharge opening, and the opening and closing action of the valve body can be more appropriately performed.

Using the flush toilet apparatus of the present invention and the drive unit for this flush toilet apparatus, variability in the amount of operation required to open and close a discharge valve apparatus portion valve body can be constrained, and opening and closing of the valve body can be appropriately performed.

DETAILED DESCRIPTION OF THE INVENTION

Below, referring to the attached figures, we explain a flush toilet apparatus according to a first embodiment of the invention.

First, referring to FIGS. 1 through 6, we explain the basic structure of a flush toilet apparatus according to a first embodiment of the invention.

Figure 1:
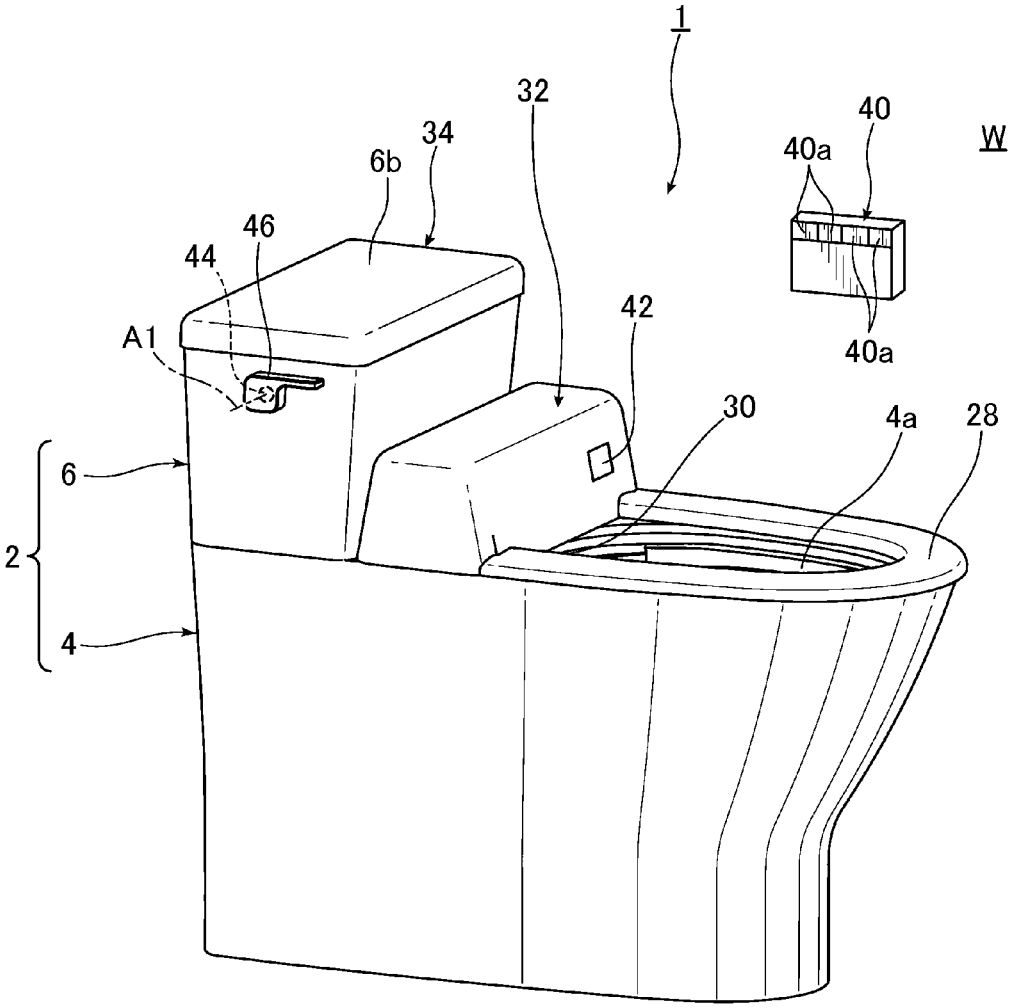
FIG. 1 is a summary perspective view showing a flush toilet apparatus according to a first embodiment of the invention.
Figure 2:
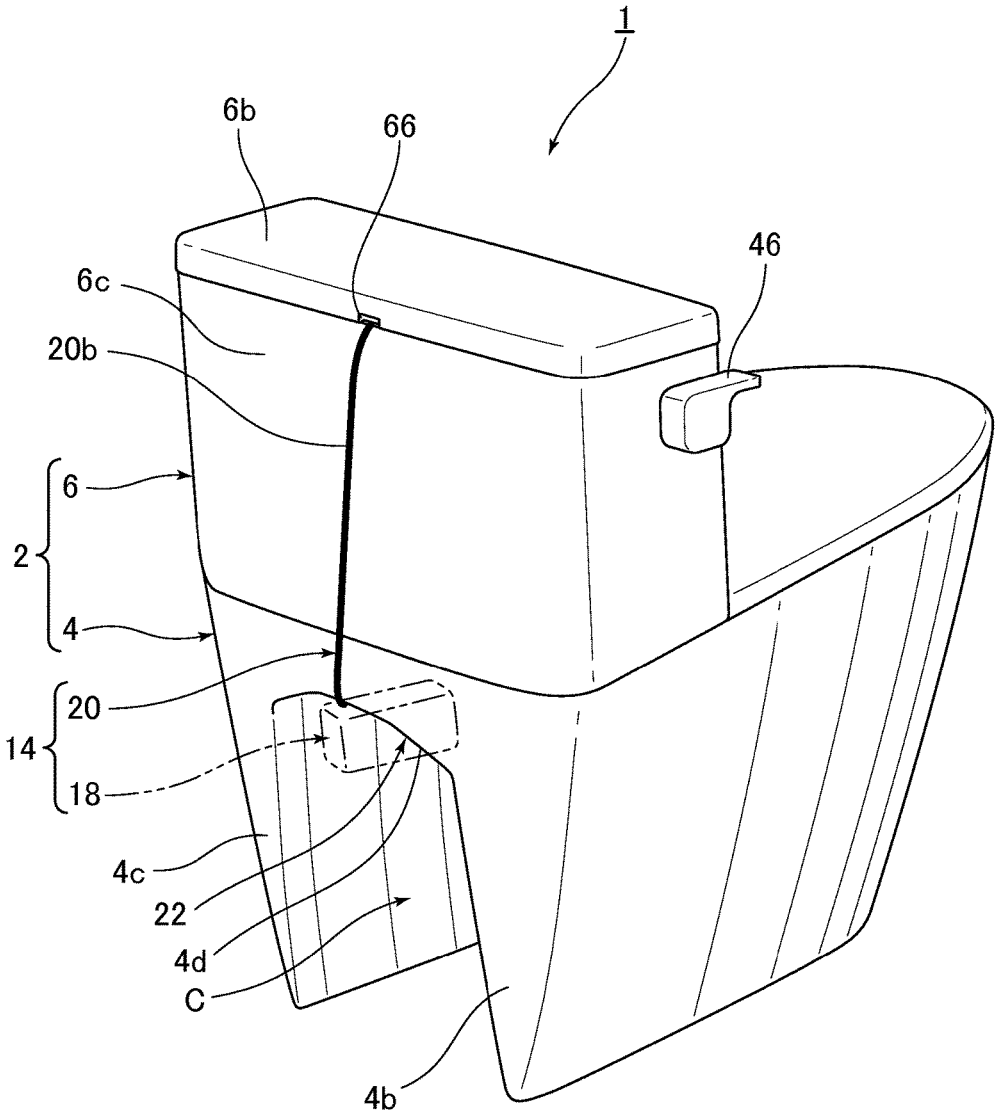
FIG. 2 is a summary perspective view seen from diagonally behind, showing a flush toilet apparatus according to a first embodiment of the invention.

FIG. 1 is a summary perspective view showing a flush toilet apparatus according to a first embodiment of the invention; FIG. 2 is a summary perspective view of the flush toilet apparatus seen from diagonally behind.

Figure 3:
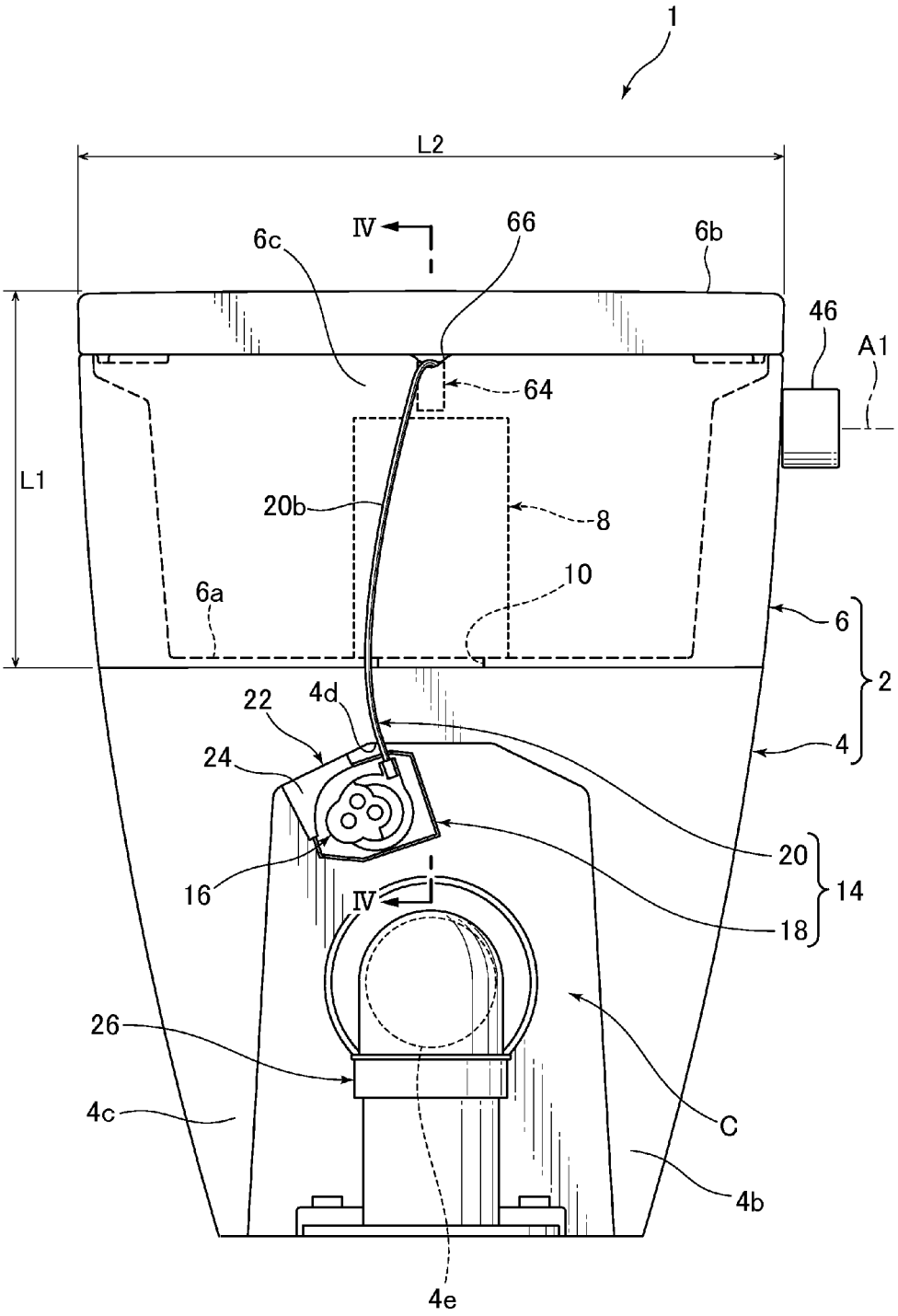
FIG. 3 is a rear elevation view showing a flush toilet apparatus according to a first embodiment of the invention.
Figure 4:
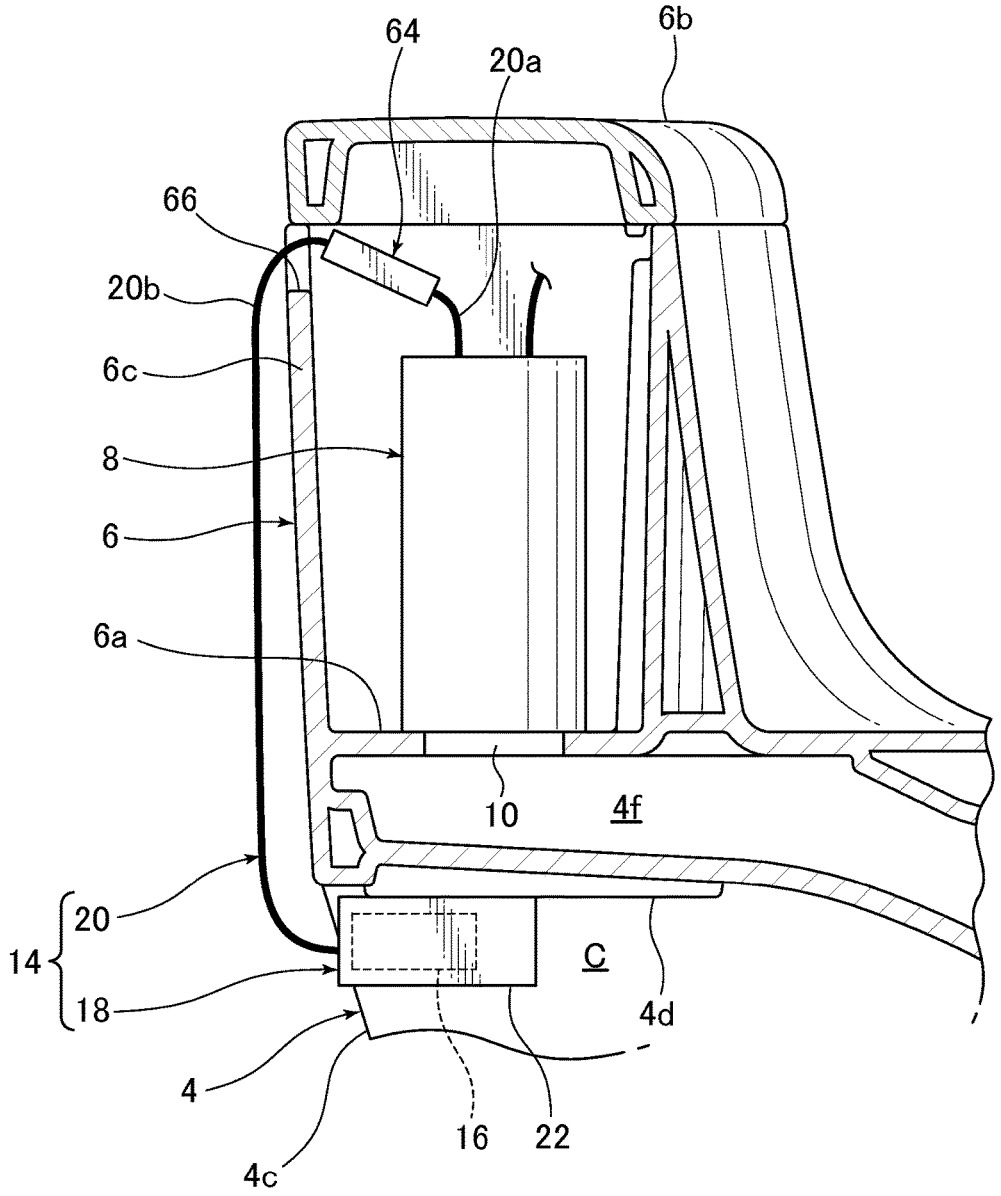
FIG. 4 is a cross section viewed along line IV-IV in FIG. 3.

FIG. 3 is a rear elevation showing a flush toilet apparatus according to a first embodiment of the invention; FIG. 4 is a cross section seen along line IV-IV of FIG. 3.

Figure 5:
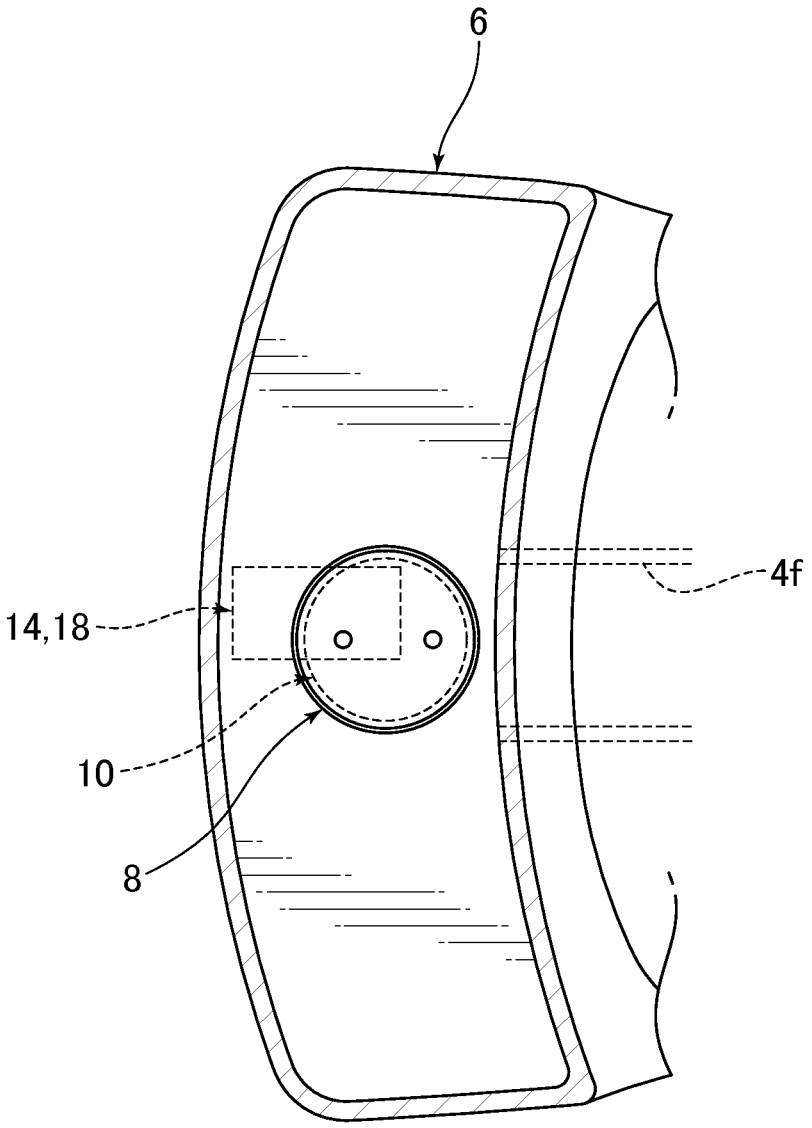
FIG. 5 is a partial expanded plan view of the rear part of a flush toilet apparatus according to a first embodiment of the invention.
Figure 6:
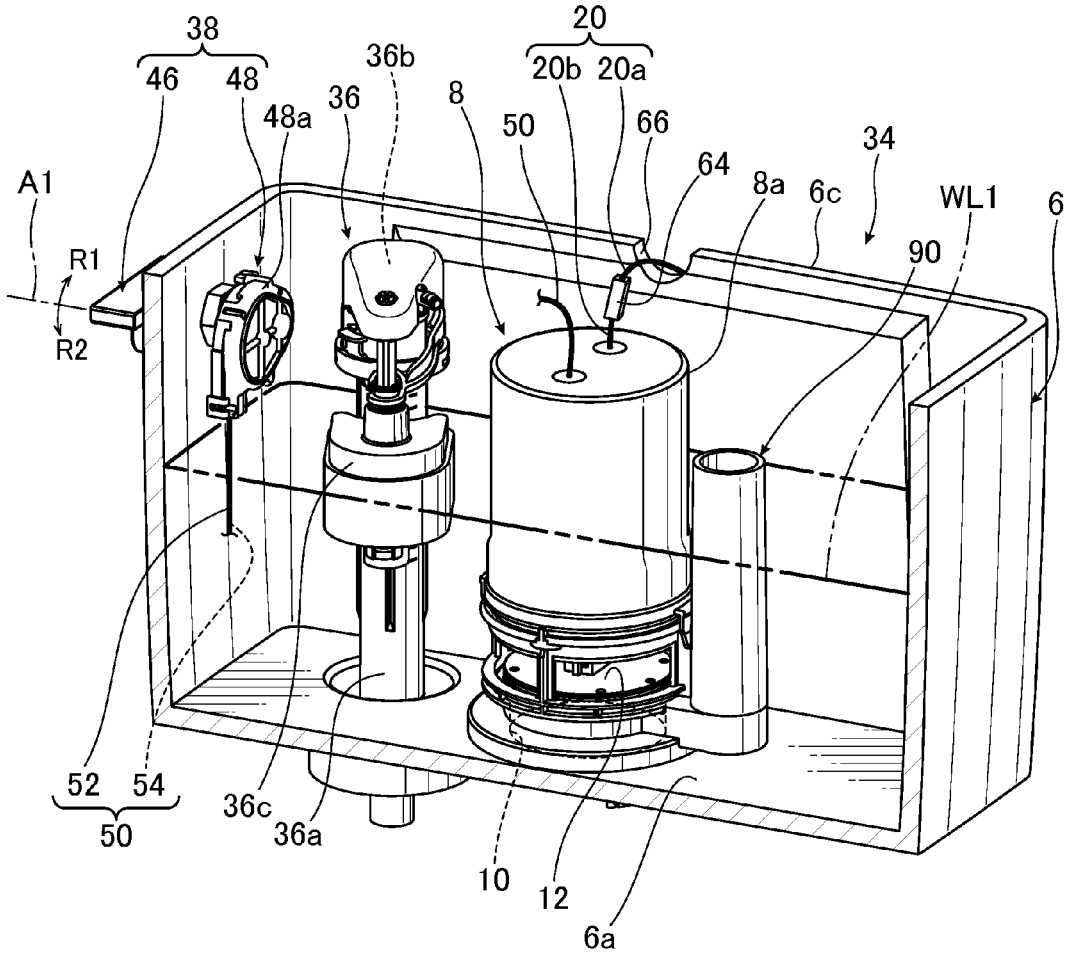
FIG. 6 is a perspective view seen from the diagonal front and above, pertaining to the interior structure when a lid body is removed in a reservoir tank portion of a flush toilet apparatus according to a first embodiment of the invention.

In addition, FIG. 5 is a partial expanded plan view of the rear part of a flush toilet apparatus according to a first embodiment of the invention, and FIG. 6 is a perspective view seen from the diagonal front and above, pertaining to the interior structure when a lid body is removed in a reservoir tank portion of a flush toilet apparatus according to a first embodiment of the invention.

First, as shown in FIGS. 1 through 3, the flush toilet 1 according to a first embodiment of the invention includes a porcelain flush toilet 2 for flushing a toilet with flush water to discharge waste. This flush toilet 2 has a toilet main body portion 4 including a bowl portion 4*a* for receiving waste, and a reservoir tank portion 6, disposed on the back side of this toilet main body portion 4, for storing flush water supplied to bowl portion 4*a* on toilet main body portion 4, being what is known as a one-piece flush toilet, in which toilet main body portion 4 and reservoir tank portion 6 are integrally formed.

Also, reservoir tank portion 6 is what is known as a low-silhouette type of reservoir tank portion, set so that its up-down vertical width measurement L1 is shorter than its left-right horizontal width measurement L2.

Note that in the flush toilet 1 and flush toilet 2 of the present embodiment we explain as an example a form known as a porcelain one-piece-type flush toilet, in which toilet main body portion 4 and reservoir tank portion 6 are integrally formed of porcelain as a single piece, but without limitation to this form, the present invention may also be applied to forms other than one-piece, wherein the toilet main body portion 4 and reservoir tank portion 6 are separately formed. With respect to flush toilet material, as well, forming the toilet from resin is also acceptable, without limitation to forming from porcelain.

With respect to reservoir tank portion 6, as well, forms of reservoir tank other than low-silhouette are also acceptable.

Next, as shown in FIGS. 2 through 6, flush toilet 1 includes a discharge valve apparatus 8, placed within reservoir tank portion 6 and disposed in the middle in the left-right direction when reservoir tank portion 6 is viewed from the front side. This discharge valve apparatus 8 includes a discharge valve body 12 for opening and closing a discharge opening 10, formed to penetrate in the up-down direction, at the middle in the left-right direction as seen from the front side of bottom portion 6*a* of reservoir tank portion 6; discharge valve body 12 is what is known as a direct-drive discharge valve apparatus portion, and opens and closes discharge opening 10 by moving up and down.

Also, flush toilet 1 includes, as a flush toilet apparatus drive unit, an automatic flush drive unit 14 for automatically opening and closing discharge valve body 12 by driving this discharge valve apparatus 8. This automatic flush drive unit 14 includes a drive unit main body portion 18 provided with and actuator 16, being an electrically powered drive portion containing a motor (not shown) or the like for electrically driving discharge valve apparatus 8; and an elongated operating member 20, connecting discharge valve apparatus 8 and drive unit main body portion 18, for operating the opening and closing of discharge valve body 12 by driving actuator 16.

Next, as shown in FIGS. 2 through 4, a pair of feet 4*b*, 4*c* formed to be spaced apart on the left and right sides, are provided on the back surface side of toilet main body portion 4, and more precisely on a part further to the rear than the bowl portion 4*a*; a skirt-like shape is formed by these feet 4*b*, 4*c*.

Also, a hollow portion C is formed on the inside of the feet 4*b*, 4*c* in such a way that the top part thereof projects outward in an essentially arch shape; an attaching portion 22, to which drive unit main body portion 18 attaches, is provided on the ceiling portion 4*d* of this hollow portion C. More precisely, the drive unit main body portion 18 is affixed to the attaching portion 22 through an affixing member 24 (see FIG. 3), described in detail below.

Furthermore, when attached to attaching portion 22 on the toilet main body portion 4, the drive unit main body portion 18 is disposed vertically below or in the vicinity of discharge valve apparatus 8, so that slack over the entire length of operating member 20 is constrained, and the longitudinal direction of drive unit main body portion 18 extends in the front-back direction of toilet main body portion 4. As shown in FIG. 3, the drive unit main body portion 18, when attached to the attaching portion 22 on the toilet main body portion 4, is positioned above the discharge trap pipe portion 4*e* connected to the bottom portion of the bowl portion 4*a* on the toilet main body portion 4, and is positioned above the water discharge socket 26 disposed inside hollow portion C so as to connect the downstream end portion (back end portion) of this discharge trap pipe portion 4*e* to the discharge pipe (not shown) on the under-floor side at the bottom of the toilet main body portion 4, such that drive unit main body portion 18 and water discharge socket 26 do not interfere with one another.

Note that in the present embodiment, we explain a form in which, when attached to the attaching portion 22 of the toilet main body portion 4, drive unit main body portion 18 is disposed vertically below or in the vicinity of discharge valve apparatus 8 so that slack over the entire length of operating member 20 is constrained, but the invention may also be applied to other forms, without limitation to this form. For example, a form may be adopted in which drive unit main body portion 18 is disposed vertically below (immediately under) discharge valve apparatus 8, and even if attaching portion 22 is not positioned vertically below (immediately under) discharge valve apparatus 8, so long as at least a part of drive unit main body portion 18 is positioned vertically below discharge valve apparatus 8 and, with respect to operating member 20, as short a length as possible is set, with operability assured.

Next, as shown in FIG. 1, a toilet seat 28 is disposed in the area from approximately the center in the front-to-back direction on the top surface of the toilet main body portion 4; a control device 32 for controlling the operation of related equipment to an extremity washing apparatus 30 for washing a user's extremities after toilet use, and the actuator 16 etc. on automatic flush drive unit 14 is provided at the back of the toilet seat 28 and the front of the reservoir tank portion 6. This control device 32 is connected to an external power supply in the area of the flush toilet apparatus 1.

Also, a flush water tank apparatus 34 for storing flush water used when flushing the bowl portion 4*a* of the toilet main body portion 4 and supplying it to the toilet main body portion 4 is provided on the reservoir tank portion 6 behind the control device 32. In addition, a lid body 6*b* is attached to the top of the reservoir tank portion 6 so as to cover it.

Note that the flush toilet 1 of the present embodiment may be applied to what is known as the wash down type of flush toilet, in which flush water supplied from the flush water tank apparatus 34 to the toilet main body portion 4 discharges waste by the drop in height direction in the bowl portion 4*a* of the toilet main body portion 4, or to various other types of flush toilets, such as what is known as the siphon type of flush toilet in which, using the siphon effect, waste is suctioned into the bowl portion 4*a* and discharged to the outside in one burst from the discharge trap pipe portion 4*e*.

Next, as shown in FIG. 6, the flush water tank apparatus 34 is comprised of a supply apparatus 36 for supplying flush water into the reservoir tank portion 6; a discharge valve apparatus 8 including a discharge valve body 12 for opening and closing the discharge opening 10 disposed at the center in the left-right direction inside reservoir tank portion 6; an automatic flush drive unit 14 for automatically opening and closing the discharge valve body 12 by driving this discharge valve apparatus 8; and a manual operation unit 38, placed on the side portion of the reservoir tank portion 6 and capable of manually operating the opening and closing of the discharge valve body 12 on the discharge valve apparatus 8.

The drive unit 14 is provided as a separate unit from the manual operation unit 38, and is disposed to be removable as needed from the reservoir tank portion 6 or the toilet main body portion 4, depending on the flush system or other specifications pertaining to the reservoir tank portion 6 or the toilet main body portion 4 including the flush water tank apparatus 34, or on the installation environment, such as water supply pressure at the installation site, or installation conditions including placement environment such as layout within the flush toilet apparatus 1 placement space, etc., or on the usage conditions for the reservoir tank portion 6 or the toilet main body portion 4 including the flush water tank apparatus 34.

While an explanation is omitted in the present embodiment, if the need arises to adjust the capacity of the tank in the reservoir tank portion 6, a capacity adjusting cap (not shown) may also be provided inside the reservoir tank portion 6.

Next, as shown in FIG. 6, the supply apparatus 36 includes: a supply pipe 36*a* connected to an external water supply source (not shown) and extending upward from the bottom portion 6*a* of reservoir tank portion 6; a supply valve 36*b*, attached to the top end portion of this supply pipe 36*a*, for switching between spouting and shutting off flush water supplied from the supply pipe 36*a* into the reservoir tank portion 6; and a float 36*c*, for switching between spouting and shutting off water by moving up and down in response to fluctuations in the water level inside the reservoir tank portion 6.

Also, a spout opening (not shown) is opened at the outer perimeter side bottom end portion of the supply pipe 36*a*; flush water which has passed through the supply valve 36*b* is spouted into the reservoir tank portion 6 from a spout opening (not shown).

Moreover, in the supply apparatus 36 when flush water in the reservoir tank portion 6 is discharged by the discharge valve apparatus 8 the flush water level drops and the float 36*c* falls; this causes the supply valve 36*b* to open, so that spouting from the spout port (not shown) starts, and spouting from the water supply source (not shown) on the flush water tank apparatus 34 into the reservoir tank portion 6 is started.

When spouting is continued and the water level in the reservoir tank portion 6 rises, the float 36*c* rises, causing the supply valve 36*b* to close, so that spouting from the spouting port (not shown) is shut-off. This results in the flush water level inside storage tank portion 6 being maintained at the predetermined water level when full.

Again, as shown in FIG. 1, an instruction device 40 including multiple operating buttons 40*a* to enable the user to instruct a flushing operation in the toilet main body portion 4, or to instruct an extremity washing operation by an extremity washing apparatus 30, is attached to the wall surface on the side of the toilet main body portion 4 in the toilet room where the flush toilet apparatus 1 is installed.

In addition, a touch sensor 42 capable of detecting the presence of a user sitting on the toilet seat 28 or the presence of a user standing in front of the toilet main body portion 4 is provided on the control device 32. When a user presses a predetermined operating button 40*a* on the instruction device 40, a signal instructing a toilet flushing operation is sent to the control device 32, and/or when the touch sensor 42 detects a user and a signal is sent to the control device 32, the control device 32 receives these signals and causes the drive unit 14 to operate.

Note that in the present embodiment we explain a form which includes both the touch sensor 42 and the instruction device 40, but it is also possible to eliminate one of these and have the control device 32 activate the drive unit 14 based on signals transmitted from the other unit only.

Next, as shown in FIG. 1 and FIGS. 3 through 6, the manual operation unit 38 includes: a manual rotation shaft 44 capable of rotating about rotational center axis A1; a manual operation lever 46 linked to one end of this manual rotation shaft 44 and disposed on the outside of the reservoir tank portion 6; a rotation mechanism unit 48 linked to the other end of the manual rotation shaft 44 and disposed on the outside of the reservoir tank portion 6 for transferring the rotational force of the manual rotation shaft 44; and a manual operation operating member 50, linked at one end to this rotation mechanism unit 48.

Note that rotary mechanism members such as multiple gears (not shown) which rotate together with the manual rotation shaft 44 upon rotation of the manual operation lever 46, or pulleys (not shown) engaging with a part of these gears (not shown), to which one end of the manual operation operating member 50 is linked, are built into the casing 48*a* on the rotation mechanism unit 48, however a detailed explanation of these is here omitted.

Figure 7:
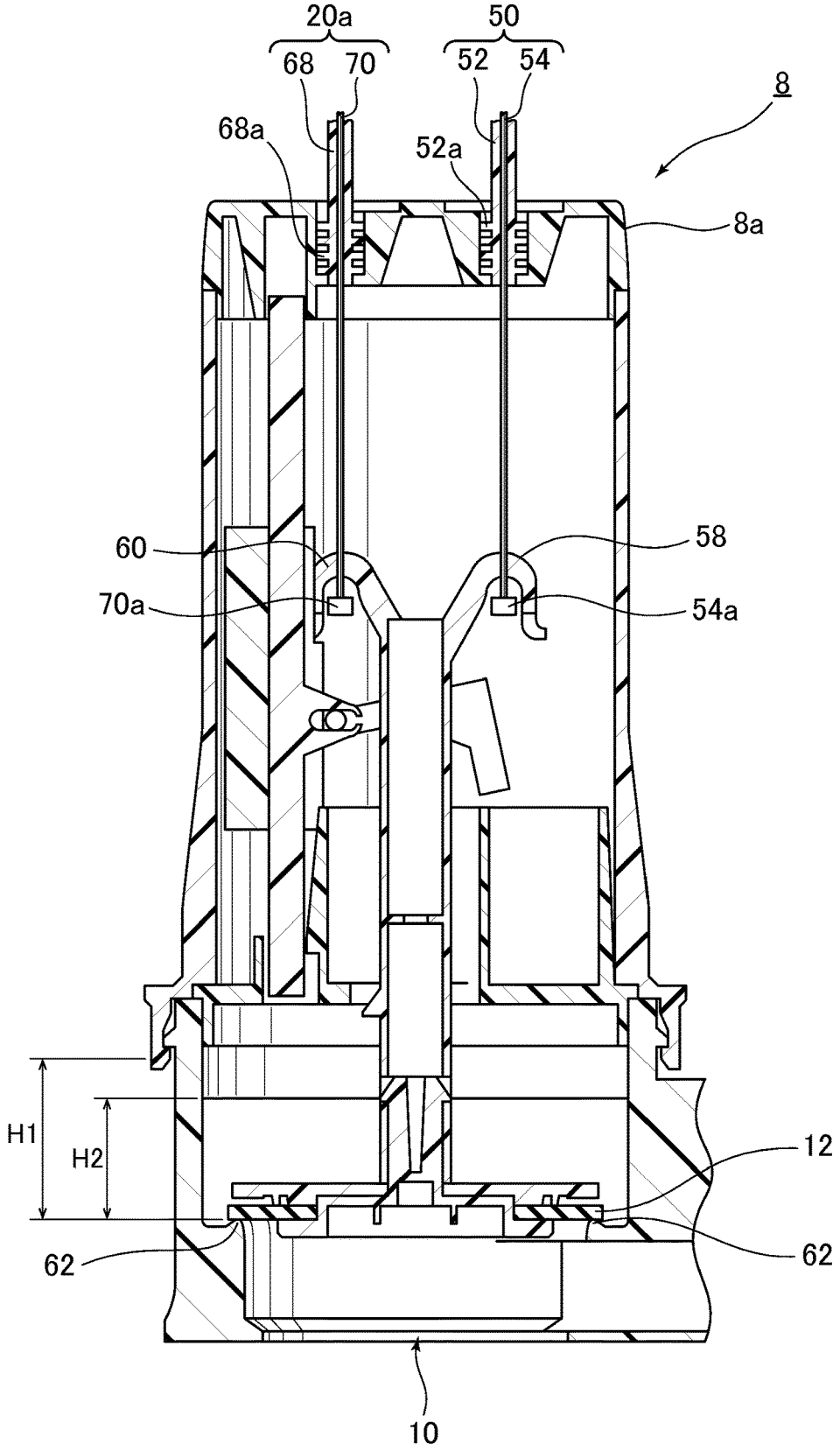
FIG. 7 is a side view cross section of the discharge valve apparatus portion of a flush toilet apparatus according to a first embodiment of the invention.

Next, FIG. 7 is a side view cross-section of the discharge valve apparatus portion of a flush toilet apparatus according to a first embodiment of the invention.

As shown in FIGS. 6 and 7, a manual operation operating member 50 includes a manual operation tube 52, one end of which is affixed to the casing 48*a* of the rotation mechanism unit 48; the tip portion 52*a* on the discharge valve apparatus portion side of this tube 52 is affixed to the top end portion of the casing 8*a* of the discharge valve apparatus 8.

Also, the manual operation operating member 50 includes a manual operating wire 54 slidably inserted into the manual operation tube 52; one end of this wire 54 is connected to a pulley (not shown) inside the casing 48*a* of the rotation mechanism unit 48.

At the same time, as shown in FIG. 7, the discharge valve apparatus 8 includes: a main shaft portion 56, to the bottom end of which the discharge valve body 12 is mounted, extending in the up-down direction; a wire linking portion 58 for manual operation, formed in a hook shape from the top end portion of this main shaft portion 56 toward the front and above; a wire linking portion 60 for electrically powered operation, formed in a hook shape from the top end portion of this main shaft portion 56 toward the front and above; a valve seat 62 formed at the top end of a discharge opening 12; wherein a projection-shaped tip portion 54*a* on the discharge valve apparatus portion side of the manual operating wire 54 is slidably linked to the wire linking portion 58 on the discharge valve apparatus 8.

Note that in this embodiment, as shown in FIG. 7, in addition to the discharge valve body 12, the main shaft portion 56 and each of the wire linking portions 58, 60, and various related members and the like for adjusting the timing at which toilet flushing is started in the large flush mode and small flush mode are respectively provided inside the casing 8*a* of the discharge valve apparatus 8, but because the minimum functionality of pulling up the main shaft portion 56 and the discharge valve body 12 can be achieved using the manual operation unit 38 or the automatic flush drive unit 14 even if these related members are omitted, an explanation of these is here omitted.

Figure 8:
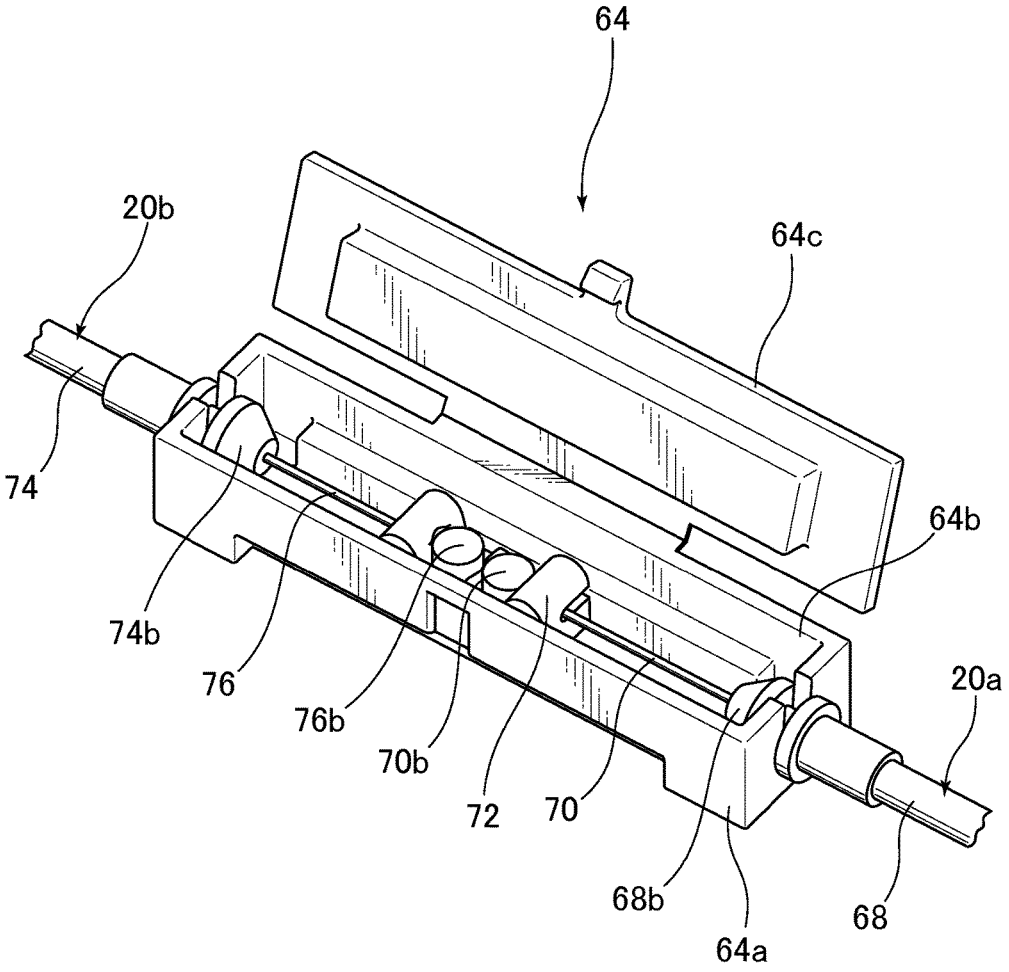
FIG. 8 is a perspective view showing the relay box in a flush toilet apparatus drive unit according to a first embodiment of the invention.

Next, FIG. 8 is a perspective view showing the relay box in a flush toilet apparatus drive unit according to a first embodiment of the invention.

As shown in FIGS. 3 and 4 and FIGS. 6 through 8, the operating member 20 for electrically powered operation includes an operating member 20*a*, one end of which is connected to the discharge valve apparatus 8, for electrically powered operation on the discharge valve apparatus portion side; and an operating member 20*b*, one end of which is connected to the drive unit main body portion 18, for electrically powered operation of the drive unit main body portion.

The drive unit 14 includes an approximately rectangular-shaped relay box 64, being a connecting means for connecting between the respective other ends of these operating members 20*a*, 20*b* when the respective lengths of these operating members 20*a*, 20*b* have been adjusted according to usage conditions. This relay box 64 includes a casing 64*a* and a lid body 64*c* mounted so as to be capable of opening and closing on an opening end surface 64*b*.

Next, as shown in FIGS. 2 through 4 and FIG. 6, a cut-out channel 66 is formed so as to penetrate from front to back at approximately the center in the left-right direction on the top edge portion of a rear wall portion 6*c* on the reservoir tank portion 6, on which the bottom edge portion of the lid body 6*b* attached to the top of the reservoir tank portion 6 is disposed from above; the operating member 20*b* for electrically powered operation on the drive unit main body portion side is insertable through the inside and outside of the reservoir tank portion 6.

Also, as shown in FIG. 6, this cut-out channel 66 is disposed above the water shut-off water level WL1, and the relay box 64 is disposed in the vicinity of the cut-out channel 66, inside the reservoir tank portion 6.

Note that the cut-out channel 66 may also be formed on the bottom edge portion of the lid body 6*b* facing in the up-down direction relative to this rear wall portion 6*c*, rather than being formed on the rear wall portion 6*c* of the reservoir tank portion 6.

Also, in the present embodiment we explain a form in which the cut-out channel 66 is adopted, but without limitation to such forms, it is also possible, in place of the cut-out channel 66, to dispose on the wall surface of the rear wall portion 6*c* of reservoir tank portion 6, adjacent to the rear side of the discharge valve apparatus 8, a hole or opening into which the operating member 20*b* for electrically powered operation, positioned above the flush water shut-off water level WL1 and on the drive unit main body portion side, can be inserted.

Next, as shown in FIGS. 6 through 8, the operating member 20*a* for electrically powered operation on the discharge valve apparatus portion side includes: an operation tube 68 for electrically powered operation, and a wire 70 for electrically powered operation made of a flexible metal such as stainless steel or the like, slidably inserted into this operation tube 68 for electrically powered operation.

With respect to the operation tube 68 for electrically powered operation, the tip portion 68*a* of the discharge valve apparatus portion thereof is affixed to the top end portion of the casing 8*a* of the discharge valve apparatus 8, and the tip portion 68*b* on the relay box side is affixed to the bottom end portion inside the casing 64*a* of the relay box 64.

Furthermore, the projection-shaped tip portion 70*a* on the electrically powered operating wire 70 is on the one hand slidably linked to the electrically powered operating wire linking portion 60 on the discharge valve apparatus 8, while the projection-shaped tip portion 70*b* on the relay box side is linked to the holding member 72, disposed to be slidable in the longitudinal direction within the relay box 64 casing 64*a*.

Figure 9:
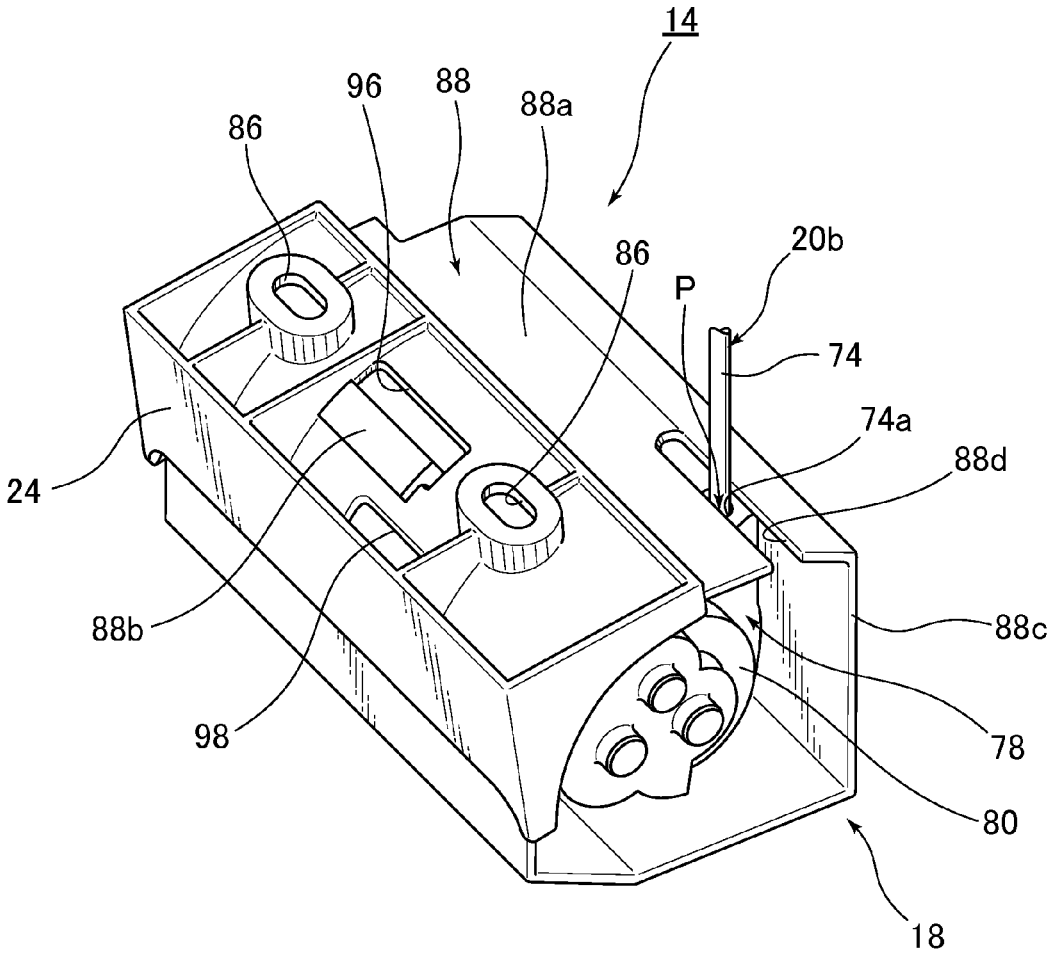
FIG. 9 is a perspective view showing the state in which the drive unit main body portion is affixed to an affixing member in a flush toilet apparatus according to a first embodiment of the invention.
Figure 10:
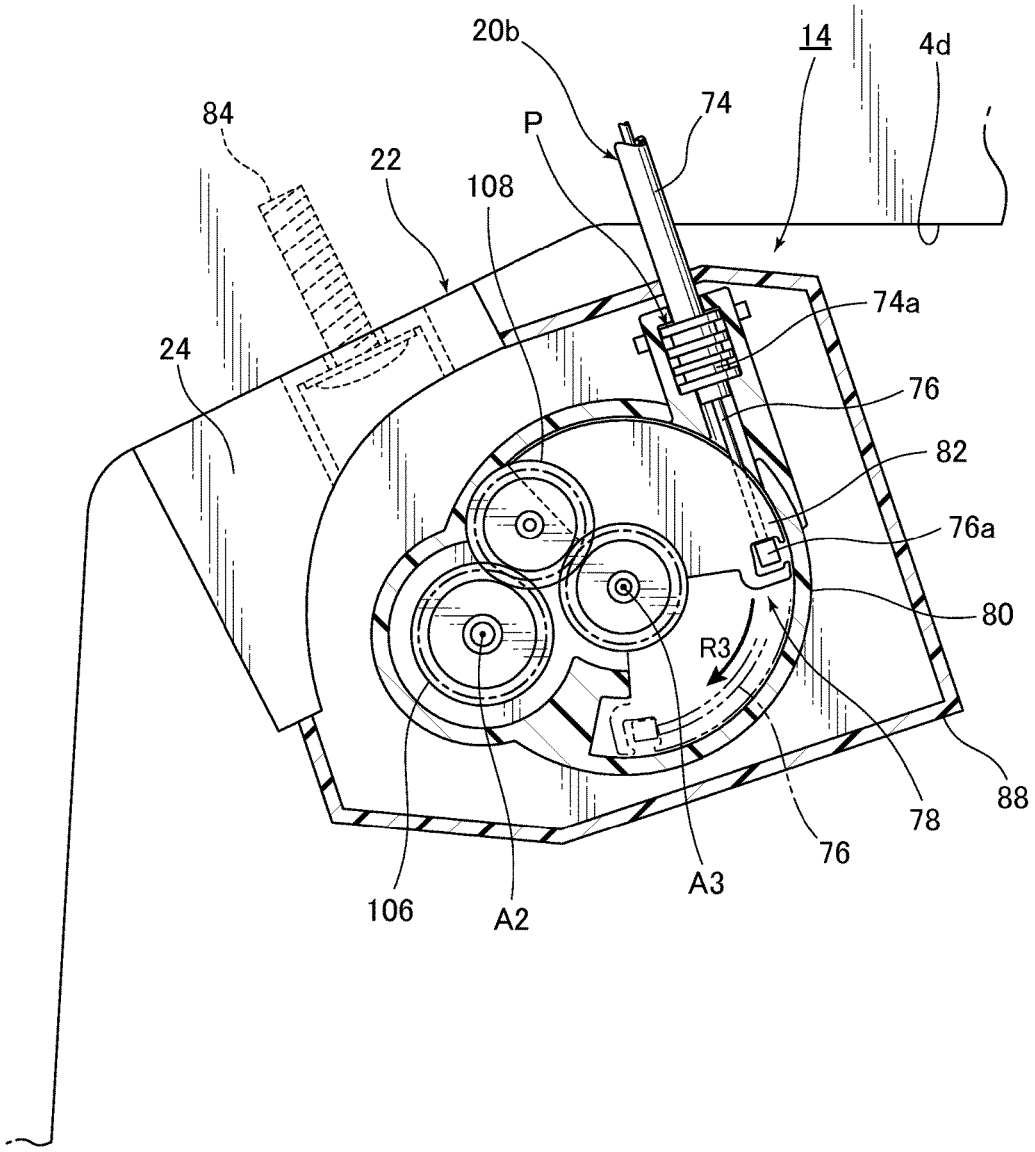
FIG. 10 is a summary diagram of the internal structure in the gear unit of a drive unit in a flush toilet apparatus according to a first embodiment of the invention.

Next, FIG. 9 is a perspective view showing the state wherein the drive unit main body portion of the drive unit in a flush toilet apparatus according to a first embodiment of the invention is affixed to an affixing member; FIG. 10 is a summary diagram of the internal structure in a drive unit gear unit of a flush toilet apparatus according to a first embodiment of the invention.

As shown in FIGS. 6 through 10, the operating member 20*b* for electrically powered operation on the drive unit main body portion side includes, as does the operating member 20*a* for electrically powered operation on the discharge valve apparatus portion side, a tube 74 for electrically powered operation, and a wire 76 for electrically powered operation made of a flexible metal such as stainless steel, slidably inserted into this tube 74 and possessing relatively superior elasticity.

As shown in FIGS. 8 and 9, with respect to tube 74 for electrically powered operation, the tip portion 74*a* thereof on the drive unit main body portion side is affixed to a casing 80 on the gear unit 78 in the drive unit main body portion 18, and a tip portion 74*b* on the relay box side is affixed to the top end portion inside the casing 64*a* on the relay box 64.

In addition, with respect to the wire 76 for electrically powered operation, the projection-shaped tip portion 76*a* on the drive unit side thereof is on the one hand linked to a part of the outside perimeter region of a pulley 82 built into the gear unit 78, while a projection-shaped tip portion 76*b* on the relay box side is linked to the holding member 72, which is slidably disposed in the longitudinal direction inside the casing 64*a* of the relay box 64.

Next, as shown in FIGS. 6 and 7, when the discharge valve body 12 is opened by manual operation of the manual operation unit 38 from a state in which the discharge valve apparatus 8 discharge valve body 12 is shutting off the discharge opening 10 (the standby state), then if the rotational directions of the manual operation lever 46 at the start of the respective flush operations in the large flush mode and small flush mode are depicted by arrows R1 and R2 in FIG. 6, turning the manual operation lever 46 in the rotational direction R1 about a rotational center axis A1 ("large flush mode operating direction R1" below) results in the integral turning of the manual rotation shaft 44 with the manual operation lever 46, whereupon the resulting rotary force is transferred to a pulley (not shown) through multiple gears (not shown) inside the rotation mechanism unit 48.

When the pulley (not shown) inside the rotation mechanism unit 48 is rotated in a predetermined direction, the wire 54 on the outside perimeter portion of this pulley (not shown) is moved as it is wound thereto, sliding relative to the tube 52, thereby lifting up the manual operating wire 54 by a predetermined length.

As shown in FIG. 7, when the wire 54 for manual operation is raised, the engagement of the tip portion 54*a* on this wire 54 with the bottom surface of the wire linking portion 58 for manual operation in the discharge valve apparatus 8 results in an opening of the discharge valve apparatus 8 main shaft portion 56 and discharge valve body 12 to a predetermined height H1 relative to the valve seat 62, together with this wire linking portion 58. At this point, the operating wires 70, 76 for electrically powered operation are not raised whatsoever, therefore the discharge valve apparatus 8 wire linking portion 60 for electrically powered operation rises together with the discharge valve apparatus 8 main shaft portion 56 and discharge valve body 12, sliding upward relative to the wire 70 for electrically powered operation.

Note that inside the manual operation unit 38, when a user removes his or her hand from the manual operation lever 46 with the wire 54 for manual operation raised and the discharge valve body 12 in an open valve state, a return spring (not shown) is provided to rotate the manual operation lever 46 so that it returns to its original standby state position.

Similarly, as shown in FIGS. 6 and 7, turning the manual operation lever 46 in the rotational direction R2 about the rotational center axis A1 ("small flush mode operating direction R2" below) results in the integral turning of the manual rotation shaft 44 with the manual operation lever 46, whereupon the resulting rotary force is transferred to a pulley (not shown) through multiple gears (not shown) inside the rotation mechanism unit 48, but the gears (not shown) involved in this case are different from the gears (not shown) involved in the large flush mode. Thus if the manual operation lever 46 is operated in operating direction R2 in the small flush mode, different from the large flush mode operating direction R1, the pulley (not shown) inside the rotation mechanism unit 48 is rotated in the same direction as the large flush mode, by a smaller rotational angle than in the large flush mode.

The wire 54 is pulled up by a predetermined length smaller than in the large flush mode and, as shown in FIG. 7, the discharge valve body 12 of the discharge valve apparatus 8 is opened to a position at a predetermined height H2 (H2<H1) relative to the valve seat 62, which is lower than the predetermined height H1 in the large flush mode.

Next, referring to FIGS. 9 through 13, we explain in concrete terms the automatic flush drive unit and attaching structure for same in a flush toilet apparatus according to a first embodiment of the invention.

Figure 11:
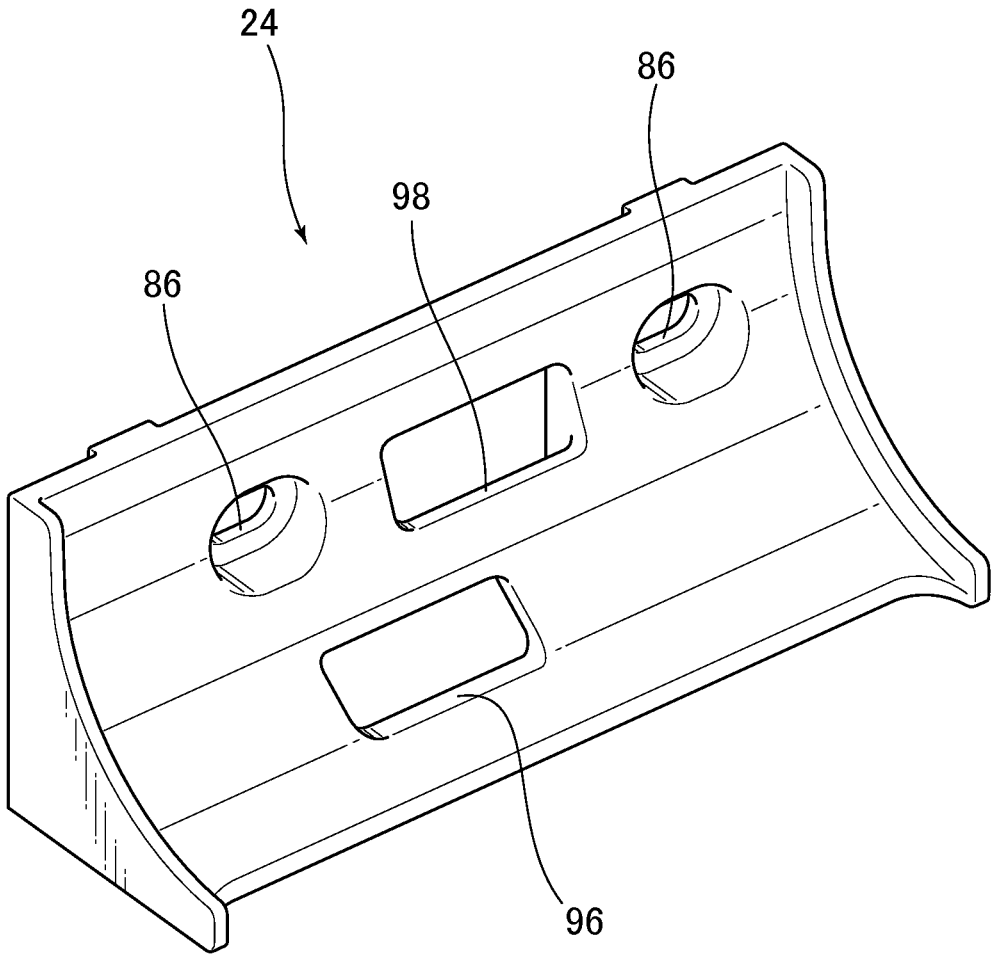
FIG. 11 is a perspective view showing an affixing member for affixing a drive unit in a flush toilet apparatus according to a first embodiment of the invention.
Figure 12:
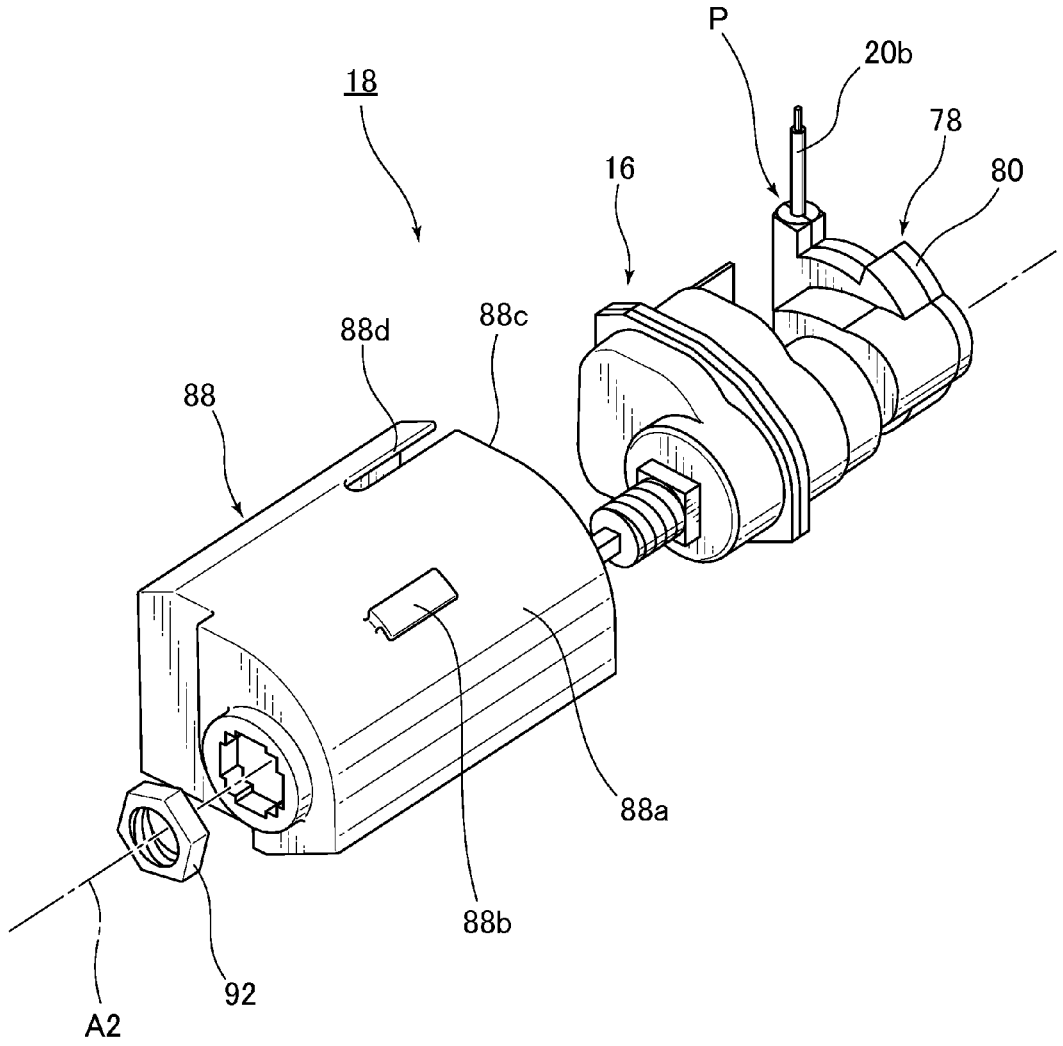
FIG. 12 is an exploded perspective view of a flush toilet apparatus drive unit according to a first embodiment of the invention.
Figure 13:
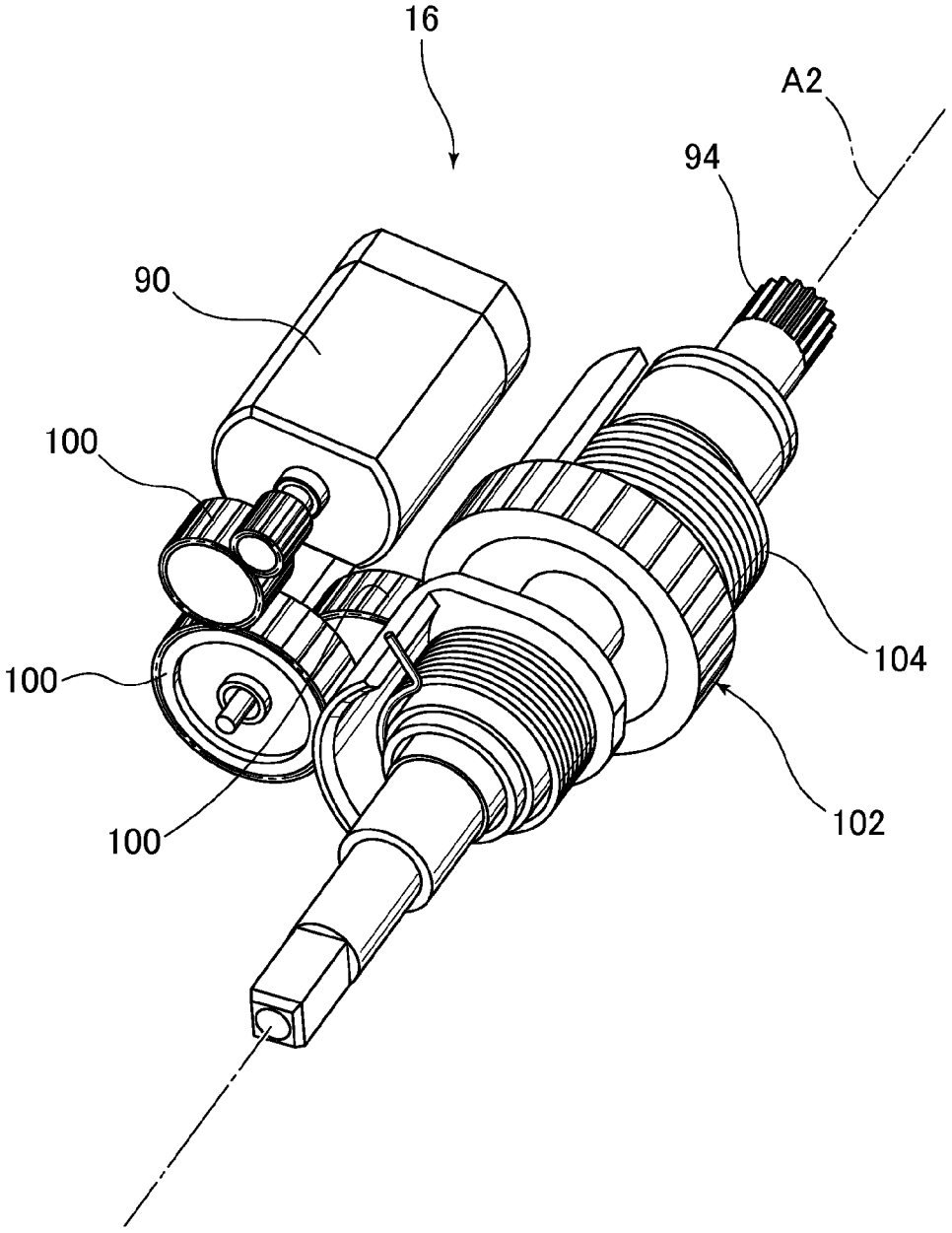
FIG. 13 is a perspective view showing the internal structure of a flush toilet apparatus drive unit actuator according to a first embodiment of the invention.

FIG. 11 is a perspective view showing an affixing member for affixing a drive unit in a flush toilet apparatus according to a first embodiment of the invention; FIG. 12 is an exploded perspective view of a flush toilet apparatus drive unit according to a first embodiment of the invention; and FIG. 13 is a perspective view showing the internal structure of a flush toilet apparatus drive unit actuator according to a first embodiment of the invention.

First, as shown in FIGS. 9 through 11, a pair of affixing screw attaching holes 86, into which a pair of affixing screws 84 are respectively inserted and attached, is formed on the affixing member 24 affixing the drive unit main body portion 18 to the attaching portion 22 on the toilet main body portion 4. When the affixing member 24 is attached to the attaching portion 22 on the toilet main body portion 4, after each of the affixing screws 84 is inserted into each of the attaching holes 86, the threaded engagement of the pair of screws (not shown) on a predetermined attaching portion 22 on the toilet main body portion 4 results in affixing the affixing member 24 itself to the attaching portion 22 on the toilet main body portion 4.

Next, as shown in FIGS. 9, 10, 12, and 13, the drive unit main body portion 18 includes an outside casing 88, an actuator 16 containing a DC motor 90 as electrically powered drive source and housed inside the outside casing 88, an affixing bolt 92 for affixing this actuator 16 relative to the outside casing 88, and a gear unit 78 housed inside the outside casing 88 and linked to the rotary shaft 94 on the actuator 16.

Also, as shown in FIGS. 9, 11, and 12, a hook portion 88*b* is formed on a portion of the outside surface of the outside casing 88 so as to project outward from that outside casing 88*a* for a predetermined length, then project in the outer circumferential direction of the outside casing 88 for a predetermined length, essentially parallel to the outer surface 88*a*.

On the other hand a first locking hole 96 and a second locking hole 98 for locking the outside casing 88 hook portion 88*b* are respectively formed on the affixing member 24; when attaching the outside casing 88 to the affixing member 24, after selecting either the first locking hole 96 or the second locking hole 98 and inserting the outside casing 88 hook portion 88*b* therein, rotating the outside casing 88 by a predetermined rotation angle about the center of center axis line A2 on the rotary shaft 94 of the actuator 16 enables the outside casing 88 hook portion 88*b* to lodge and lock in either the first locking hole 96 or the second locking hole 98.

Note that in the present embodiment, as shown in FIG. 9, we explain the form in which the outside casing 88 hook portion 88*b* is locked to the first locking hole 96, but a selection in which the outside casing 88 hook portion 88*b* is locked into the second locking hole 98 is also acceptable depending on the form of the toilet main body portion 4 attaching portion 22, the type of the toilet main body or reservoir tank portion, or the flush toilet apparatus 1 installation conditions.

I.e., depending on the form and type of the toilet main body portion 4 or the reservoir tank portion 6, the affixing member 24 can, with respect to the drive unit main body portion 18, be affixed to the toilet main body portion 4 attaching portion 22 in an orientation wherein slack over the entire length of the operating member 20 for electrically powered operation (the entire length of the operating member 20*a* for electrically powered operation on the discharge valve apparatus portion side and the operating member 20*b* for electrically powered operation on the drive unit main body portion side) is constrained.

As shown in FIGS. 3, 4, 9, 10, and 12, on the outside casing outer surface 88*a* of the outside casing 88 an outside casing cut-out channel 88*d* is formed in the longitudinal direction from the outside casing opening end portion 88*c* of the outside casing 88, so that only the operating member 20*b* for electrically powered operation on the drive unit main body portion side is removed to outside the outside casing 88, with the gear unit 78 housed inside the outer surface 88*a*.

Thus in a state wherein the drive unit main body portion 18 is attached to the attaching portion 22 of the toilet main body portion 4 through the affixing member 24, relative to the operating member 20*b* for electrically powered operation on the drive unit main body portion side, after passing through the cut-out channel 66 on the rear wall portion 6*c* of the reservoir tank portion 6 and the cut-out channel 88*d* on the outside casing 88, respectively, the part P (see FIGS. 10 and 12) connected to the gear unit 78 of the drive unit main body portion 18 is essentially perpendicularly connected to the drive unit main body portion 18.

Moreover, as shown in FIG. 13, the actuator 16 includes: a DC motor 90, connected to electrical wire (not shown) extending from the control device 32 and supplied over electrical wire (not shown) with electrical power supplied to the control device 32 from an external power source in the area of the flush toilet apparatus 1; multiple gears 100 turned by the driving of this DC motor 90; an output gear 102 for outputting the rotational drive force transferred from these multiple gears 100; a rotary shaft 94 to which torque is transferred from the output gear 102 integrally linked on a concentric axis relative to this output gear 102; and a return spring 104, attached on a concentric axis to the outside circumferential side of the rotary shaft 94 so as to elastically deform as a result of the rotation of the output gear 102.

For example, when electrical power is supplied from the control device 32 and the DC motor 90 rotates, that torque is transferred to the output gear 102 through multiple gears 100, and the output gear 102 rotates in a predetermined rotational direction. The rotational torque of this output gear 102 is transferred to the rotary shaft 94, and the rotary shaft 94 rotates in a predetermined rotational direction together with the output gear 102. At this point, because the return spring 104 is contacting the rotating output gear 102, it elastically deforms due to the torque from the output gear 102; thereafter when driving by the DC motor 90 is stopped, the output gear 102 rotates in the reverse direction from the predetermined rotational direction due to the elastic resilience of the return spring 104, and rotary shaft 94 also rotates in the opposite direction together with the output gear 102.

Also, as shown in FIGS. 10 and 12, a first gear 106 connected to the rotary shaft 94 of the actuator 16, a second gear 108 connected to this first gear 106, and a pulley 82 connected to this second gear 108 are built into the casing 80 on the gear unit 78.

For example, if the discharge valve body 12 is opened by an electrically powered operation using the drive unit 14 from a state wherein the discharge valve body 12 is shutting off the discharge opening 10 (standby state) as shown in FIG. 7, then when either the user instructs a toilet flushing operation by pushing a predetermined operating button 40*a* on the command device 40, or a user is sensed by the touch sensor 42, these signals are transmitted to the control device 32, and the DC motor 90 in the drive unit 14 is activated by a command from the control device 32.

As shown in FIGS. 10, 12, and 13, when the rotary shaft 94 of the actuator 16 rotates at a predetermined rpm in a predetermined rotational direction about the rotational center axis line A2, this rotational drive force is transferred to the pulley 82 through the second gear 108 from the first gear 106 on the gear unit 78 and, as shown in FIG. 10, the pulley 82 rotates at a predetermined rotational angle in a predetermined rotational direction R3 about the rotational center axis A3. By this means, the wire 76 for electrically powered operation is movably linked to a portion of the outer perimeter area of the pulley 82 in the rotational tangent direction of the pulley 82 as it is wound onto the outside perimeter portion of the pulley 82 with the rotation of the pulley 82.

Moreover, when the wire 76 moves in the rotational tangent direction of the pulley 82, the operating wire 70 for electrically powered operation connected to the wire 76 for electrically powered operation through the holding member 72 inside the relay box 64 shown in FIG. 8 is raised in its entirety by a predetermined length. Thus the discharge valve body 12 shown in FIG. 7 is also raised by a predetermined length together with the operating wire 70 for electrically powered operation and opened. At this point, the operating wire 54 for manual operation shown in FIG. 7 is not raised whatsoever, therefore the discharge valve apparatus 8 wire linking portion 58 for manual operation rises together with the discharge valve apparatus 8 main shaft portion 56 and discharge valve body 12, sliding upward relative to the wire 54 for manual operation.

When the discharge valve body 12 is opened by electrically powered operation using the drive unit 14 in the large flush mode, the main shaft portion 56 and the discharge valve body 12 in the discharge valve apparatus 8 open to a position at predetermined height H1 relative to the valve seat 62, but in the small flush mode, because the rotational angle of the pulley 82 becomes smaller than in the large flush mode, the discharge valve apparatus 8 discharge valve body 12 opens to a position relative to the valve seat 62 at a predetermined height H2 lower than the predetermined height H1 in the large flush mode (H2<H1). Flush water in the reservoir tank portion 6 is supplied from the discharge opening 10 to the water conduit 4*f* in the toilet main body portion 4 (see FIGS. 4 and 5), and is supplied into the bowl portion 4*a* of the toilet main body portion 4, whereby flushing is carried out.

In addition, in the present embodiment the respective manual operation by the manual operation unit 38 and electrically powered operation by the drive unit 14 independently raise the discharge valve body 12 on the discharge valve apparatus 8 and cause the valve to open, but the greater the amount of raising of discharge valve body 12 is set, and the higher the rise height (stroke) of the discharge valve body 12 relative to the valve seat 62 is set, or the longer the duration of opening of the discharge valve body 12 is set, the greater is the quantity of flush water discharged from the discharge opening 10 on the reservoir tank portion 6 of the flush water tank apparatus 34 by the discharge valve apparatus 8 and supplied to the water conduit 4*f* in the toilet main body portion 4.

Note that in the present embodiment we have explained an example in which both the drive unit 14 for automatic flushing and the manual operation unit 38 are employed but if, depending on the flush system or other specifications pertaining to the reservoir tank portion 6 or the toilet main body portion 4 including the flush water tank apparatus 34, or on the installation environment, such as water supply pressure at the installation site, or on installation conditions including placement environment such as layout within the flush toilet apparatus 1 placement space, etc., the drive unit 14 for automatic flushing is not required, then the operating member 20*a* for electrically powered operation on the drive unit 14 discharge valve apparatus side may be removed from the discharge valve apparatus 8, and the drive unit main body portion 18 may be removed from the attaching portion 22 on the toilet main body portion 4, along with the relay box 64 and the operating members 20*a*, 20*b* for electrically powered operation.

In a flush toilet apparatus 1 according to the first embodiment of the invention described above, with respect to the automatic flushing drive unit 14 which drives the discharge valve apparatus 8 inside the reservoir tank portion 6 placed on the rear side on the toilet main body portion 4, in a state wherein the drive unit main body portion 18 thereof is attached to the attaching portion 22 provided at the back surface side of the toilet main body portion 4, the drive unit main body portion 18 is disposed at the bottom of the reservoir tank portion 6 and on the back surface side of the toilet main body portion 4, and is disposed in the vicinity of an area vertically below the discharge valve apparatus 8, hence slack over the entire length of the elongated operating member 20 (20*a*, 20*b*) for electrically powered operation of drive unit 14 can be constrained.

Therefore unnecessary bending of the operating member 20 caused by excessive total length of the drive unit portion 14 operating member 20 (20*a*, 20*b*) between the discharge valve apparatus 8 inside the reservoir tank portion 6 and the drive unit main body portion 18 can be constrained, so that the electrically powered operating member 20 can accurately operate the opening and closing action of the discharge valve body 12 in the discharge valve apparatus 8 by driving the actuator 16 in the drive unit main body portion 18, and variability in the amount of that operation can be constrained. A flush toilet apparatus 1 and drive unit 14 capable of appropriately performing the opening and closing action of the discharge valve body 12 in the discharge valve apparatus 8 can thus be provided.

In the flush toilet apparatus 1 of the present embodiment, having an affixing member 24 for affixing the drive unit main body portion 18 to the toilet main body portion 4 attaching portion 22 in accordance with toilet main body portion 4 or reservoir tank portion 6 type, oriented so that slack over the entire length of the operating member 20 (20*a*, 20*b*) for electrically powered operation is constrained, enables reliable affixing of the drive unit main body portion 18 to the toilet main body portion 4 attaching portion 22 through this affixing member 24 in an orientation such that slack on the entire length of the operating member is constrained.

Therefore since the drive force from the actuator 16 on the drive unit main body portion 18 can be efficiently and reliably transferred to the electrically powered electrically powered operating member 20, the discharge valve body 12 in the discharge valve apparatus 8 can be accurately moved relative to the discharge opening 10, and opening and closing of the discharge valve body 12 can be appropriately conducted.

Moreover, in a flush toilet apparatus 1 according the present embodiment, the reservoir tank portion 6 forms a rear wall portion 6*c* on the back side of the discharge valve apparatus 8, and operating member 20*b* for electrically powered operation on the drive unit main body portion side, by the formation of a cut-out channel 66 on the inside and outside of the reservoir tank portion 6, is assured operability with respect to the operating member 20 (20*a*, 20*b*) for electrically powered operation between the discharge valve apparatus 8 and the drive unit main body portion 18, and total length can be made short, therefore unnecessary bending and the like of the operating member 20 (20*a*, 20*b*) for electrically powered operation caused by excessive total length of the operating member 20 (20*a*, 20*b*) for electrically powered operation between the discharge valve apparatus 8 and the drive unit main body portion 18 can be constrained.

Therefore variability in the amount of operation required when the operating member 20 (20*a*, 20*b*) for electrically powered operation operates the opening and closing action of the discharge valve body 12 in the discharge valve apparatus 8 at the time when drive unit 14 actuator 16 is driven can be constrained, and the discharge valve body 12 can be appropriately opened and closed.

In a flush toilet apparatus 1 according to the present embodiment, with respect to the operating member 20*b* for electrically powered operation on the drive unit main body portion side, the part P connected to the gear unit 78 passes through the cut-out channel 66 in the rear wall portion 6*c* of the reservoir tank portion 6, then passes through the cut-out channel 88*d* in the outside casing 88 of the drive unit main body portion 18 and is connected essentially perpendicularly to the drive unit main body portion 18, such that the entire length of the operating member 20 (20*a*, 20*b*) for electrically powered operation can be shortened, with the result that unnecessary bending of the operating member 20 (20*a*, 20*b*) for electrically powered operation caused by excessive length of the total length of the operating member 20 (20*a*, 20*b*) for electrically powered operation between the discharge valve apparatus 8 and the drive unit main body portion 18 can be constrained.

Therefore variability in the amount of operation required when the operating member 20 (20*a*, 20*b*) for electrically powered operation operates the opening and closing action of the discharge valve body 12 in the discharge valve apparatus 8 during driving of the drive unit 14 actuator 16 can be constrained, and the discharge valve body 12 can be appropriately opened and closed.

Furthermore, in the flush toilet apparatus 1 according to the present embodiment, the operating member 20 (20*a*, 20*b*) for electrically powered operation includes an operating member 20*a* for electrically powered operation on the discharge valve apparatus portion side, one end of which is connected to the discharge valve apparatus 8, and an operating member 20*b* for electrically powered operation on the drive unit main body portion, one end of which is connected to the drive unit main body portion 18; wherein the drive unit portion 14 further includes a relay box 64 connecting one end of the operating member 20*a* for electrically powered operation on the discharge valve apparatus side and one end of the operating member 20*b* for electrically powered operation on the drive unit main body portion side, with the respective lengths of the operating members 20*a*, 20*b* for electrically powered operation adjusted according to usage conditions such that the total length of the electrically powered operating member 20 (20*a*, 20*b*) for electrically powered operation can be appropriately adjusted according to usage conditions, so that unnecessary bending of the operating member 20 (20*a*, 20*b*) for electrically powered operation caused by excessive length of the total length of the operating member 20 (20*a*, 20*b*) for electrically powered operation between the discharge valve apparatus 8 and the drive unit main body portion 18 can be constrained.

Therefore variability in the amount of operation required when the operating member 20 (20*a*, 20*b*) for electrically powered operation operates the opening and closing action of the discharge valve body 12 in the discharge valve apparatus 8 at the time when drive unit 14 actuator 16 is driven can be constrained, and the discharge valve body 12 can be appropriately opened and closed.

Note the locations for connecting the operating member 20 (20*a*, 20*b*) using the relay box 64 can be determined in advance at the time of factory shipment, or may also be determined at the installation site by the installer as required by site conditions.

In a flush toilet apparatus 1 according to the present embodiment, the operating member 20*a* for electrically powered operation on the discharge valve apparatus portion side includes a tube 68 for electrically powered operation and a wire 70 for electrically powered operation, made of a flexible metal such as stainless steel, slidably inserted into this tube 68 and possessing relatively superior elasticity, whereby the operating member 20*b* for electrically powered operation on the drive unit main body portion side includes a tube 74 for electrically powered operation and a wire 76 for electrically powered operation made of a flexible metal such as stainless steel, slidably inserted into this tube 74 and possessing relatively superior elasticity, thereby enabling an improvement in the durability of each wire 70, 76, since each of the wires 70, 76 on the operating members 20*a*, 20*b* for electrically powered operation is protected by the tubes 68, 74.

Furthermore, by constraining the slack over the entire length of the operating members 20*a*, 20*b* for electrically powered operation, the sliding resistance between each of the tubes 68, 74 and the wires 70, 76 can be reduced when the drive unit 14 actuator 16 and the gear unit 78 are driven and each of the wires 70, 76 on the operating member 20 (20*a*, 20*b*) for electrically powered operation slides relative to each of the tubes 68, 74, therefore when each of the wires 70, 76 of the operating member 20 (20*a*, 20*b*) for electrically powered operation slides, the discharge valve body 12 can be made to slide accurately relative to the discharge opening 10, and the opening and closing action of discharge valve body 12 can be more appropriately performed.

In addition, in the flush toilet apparatus 1 according to the present embodiment, the drive unit main body portion 18 actuator 16 includes a DC motor 90 and multiple gears 100, 102 rotated by this DC motor 90, and the drive unit main body portion 18 gear unit 78 includes a first gear 106 connected to the rotary shaft 94 of the actuator 16, a second gear 108 connected to this first gear 106, and a pulley 82 connected to this second gear 108; whereby the wire 76 for electrically powered operation is connected so as to be movable in the rotational tangent direction of the pulley 82 in the gear unit 78 during driving of the actuator 16 by the linkage of a portion of the projection-shaped tip portion 76*a* on the drive unit side of the electrically powered operating wire 76 to the outside circumference area of the pulley 82, such that the total length of each of the wires 70, 76 on each of the operating members 20*a*, 20*b* for electrically powered operation can be shortened, so that unnecessary bending and the like of the wires 70, 76 due to excessive total length of the wires 70, 76 between the discharge valve apparatus 8 and the drive unit main body portion 18 can be constrained.

Therefore variability in the amount of operation required when the operating member 20 (20*a*, 20*b*) for electrically powered operation open and close the discharge valve body 12 on the discharge valve apparatus 8 upon driving of the drive unit 14 actuator 16 can be constrained, and when the wires 70, 76 of operating members 20*a*, 20*b* for electrically powered operation slide relative to the tubes 68, 74, the sliding resistance between the tubes 68, 74 and the wires 70, 76 can be reduced, so that during sliding of the wires 70, 76 of operating members 20*a*, 20*b* for electrically powered operation, the discharge valve body 12 can be more accurately moved relative to the discharge opening 10, and the action of opening and closing the discharge valve body 12 can be more appropriately performed.

In a flush toilet apparatus 1 according to the present embodiment, relative to what is known as one-piece type flush toilets, as well, in which the reservoir tank portion 6 is integrally formed at the rear side on the toilet main body portion 4, the toilet main body portion 4 includes: an attaching portion 22, disposed at the bottom of the reservoir tank portion 6, to which a drive unit main body portion 18 is attached in such a way that slack over the entire length of the operating member 20 (20*a*, 20*b*) for electrically powered operation is constrained; this drive unit main body portion 18, attached to this attaching portion 22, is disposed close to the area below the discharge valve apparatus 8, therefore unnecessary bending of the operating member 20 (20*a*, 20*b*) for electrically powered operation caused by excessive total length of the operating member 20 (20*a*, 20*b*) for electrically powered operation between the discharge valve apparatus 8 and the drive unit main body portion 18 can be constrained.

Therefore variability in the amount of operation required when the wires 70, 76 of the operating member 20 (20*a*, 20*b*) for electrically powered operation open and close the discharge valve body 12 in the discharge valve apparatus 8 upon driving of the drive unit 14 actuator 16 can be constrained, and the discharge valve body 12 can be appropriately opened and closed.

Furthermore, in the flush toilet apparatus 1 according to the present embodiment, with respect as well to what is known as the low-silhouette reservoir tank portion 6, inside of which space is relatively limited and wherein the up-down vertical width dimension L1 of reservoir tank portion 6 is set to be shorter than the left-right horizontal width dimension L2, the toilet main body portion 4, disposed below reservoir tank portion 6, includes the attaching portion 22 to which the drive unit main body portion 18 is attached such that slack in the total length of the operating member 20 (20*a*, 20*b*) for electrically powered operation is constrained; because drive unit main body portion 18, attached to this attaching portion 22, is disposed close to the area vertically below the discharge valve apparatus 8, unnecessary bending of the operating member 20 (20*a*, 20*b*) for electrically powered operation caused by excessive total length of the operating member between the discharge valve apparatus portion and the drive unit main body portion can be constrained.

Therefore variability in the required amount of operation when the wires 70, 76 of operating member 20 (20*a*, 20*b*) for electrically powered operation operate the opening and closing action of the discharge valve body 12 in the discharge valve apparatus 8 during driving of the drive unit 14 actuator 16 can be constrained, and the discharge valve body 12 can be appropriately opened and closed.

Figure 14:
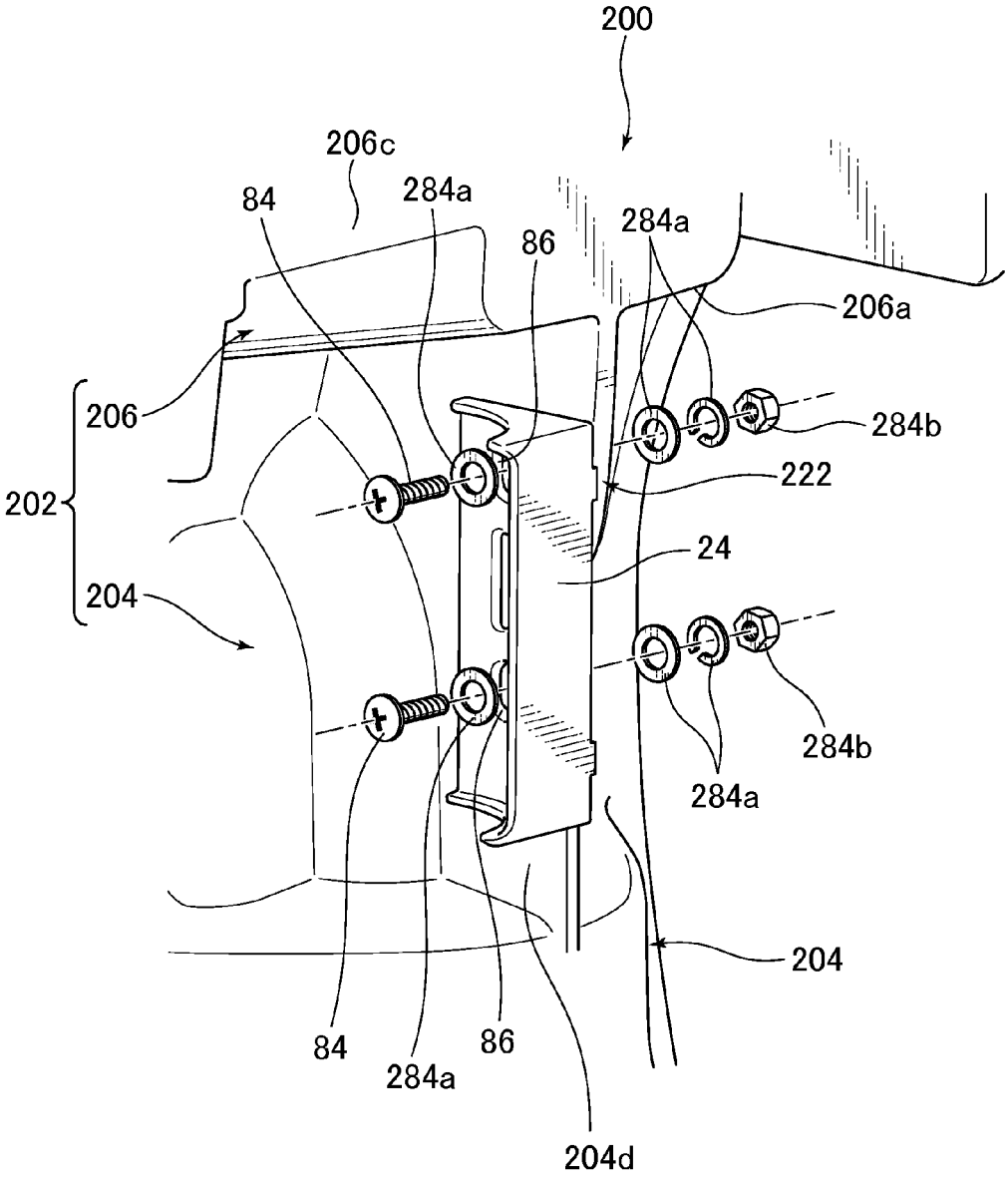
FIG. 14 is a partial expanded perspective view of the drive unit attaching portion, and the affixing member part for affixing the drive unit main body portion to the attaching portion of this drive unit, according to a first embodiment of the invention.
Figure 15:
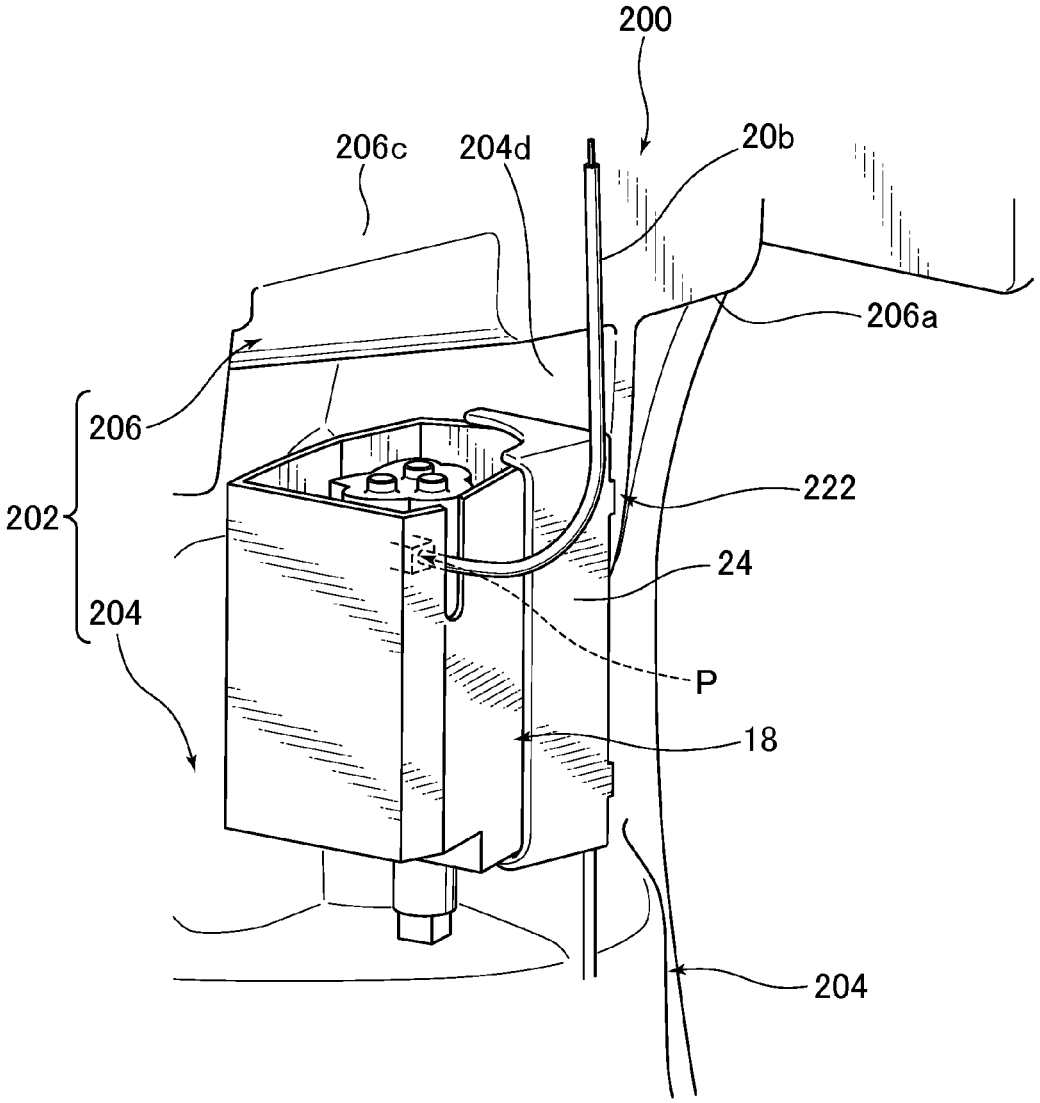
FIG. 15 is a partial expanded perspective view showing the state in which the drive unit main body portion of a drive unit is affixed through an affixing member to a toilet main body drive unit affixing portion in a flush toilet apparatus according to a second embodiment of the invention.
Figure 16:
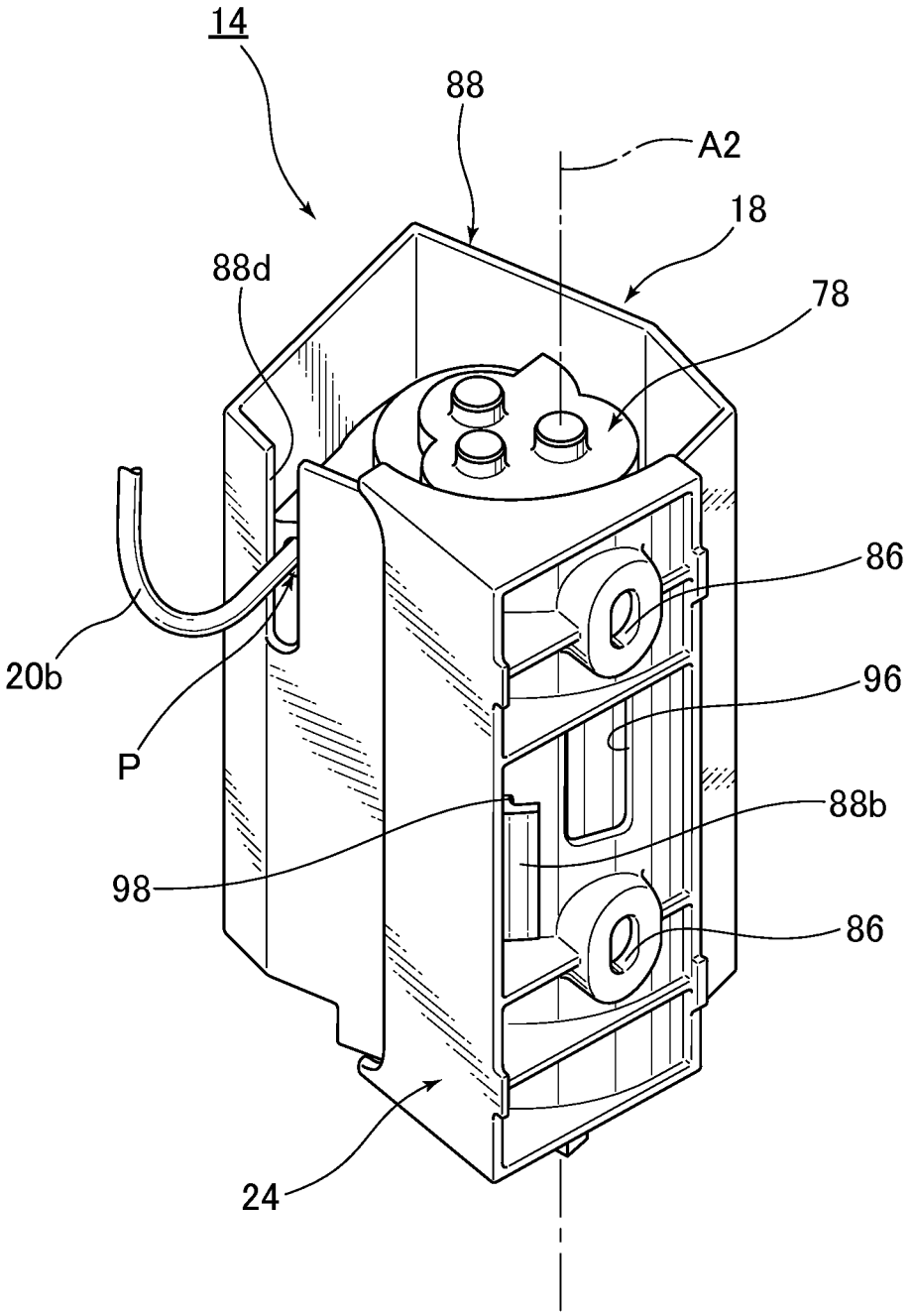
FIG. 16 is a perspective view showing the state in which the drive unit main body portion is affixed to an affixing member in a flush toilet apparatus according to a second embodiment of the invention.

Next, referring to FIGS. 14 through 16, we explain a flush toilet apparatus according to a second embodiment of the invention.

FIG. 14 is a partial expanded perspective view of the drive unit attaching portion and the affixing member part for affixing the drive unit main body portion to the attaching portion of this drive unit, according to a first embodiment of the invention. FIG. 15 is a partial expanded perspective view showing the state in which the drive unit main body portion of a drive unit is affixed through an affixing member to a toilet main body drive unit affixing portion in a flush toilet apparatus according to a second embodiment of the invention. Additionally, FIG. 16 is a perspective view showing the state in which the drive unit main body portion is affixed to an affixing member in a flush toilet apparatus according to a second embodiment of the invention.

Note that in the flush toilet apparatus according to a second embodiment of the invention shown in FIGS. 14 through 16, the same reference numerals are assigned for those parts which are the same as the flush toilet apparatus of the first embodiment of the invention shown in FIGS. 1 through 13, and an explanation thereof is omitted.

As shown in FIGS. 14 through 16, the flush toilet apparatus 200 according to a second embodiment of the invention has in common with the above-described flush toilet apparatus 1 of the first embodiment of the invention that the drive unit main body portion 18 of the drive unit 14 is removably attached to an attaching portion 222 on the back surface side of a toilet main body portion 224 on a one-piece flush toilet 202 through the affixing member 24.

However, in the flush toilet apparatus 200 according to a second embodiment of the invention, the toilet main body portion 204 differs from the toilet main body portion 4 in the flush toilet apparatus 1 according to the first embodiment of the invention in that the back surface part is not formed into a skirt shape, and no hollow portion C is formed.

In addition, the flush toilet apparatus 200 according to a second embodiment of the invention differs from the flush toilet apparatus 1 in that the orientation of the drive unit main body portion 18 and the affixing member 24 when the drive unit main body portion 18 is attached to the attaching portion 222 on the back surface side of the toilet main body portion 204 through the affixing member 24 is such that its respective longitudinal directions are disposed to extend in the up and down direction of the toilet main body portion 4, whereas the orientation of the drive unit main body portion 18 and the affixing member 24 in the flush toilet apparatus 1 according to a first embodiment of the invention is such that its respective longitudinal directions are disposed to extend in the front-to-back direction of the toilet main body portion 4.

I.e., as shown in FIG. 14, in a flush toilet apparatus 200 according to a second embodiment of the invention, a rib 204*d* is formed extending down from the bottom portion 206*a* of the reservoir tank portion 206 in what appears as the center part in the left-right direction when this rear surface part is seen from the back surface side in the rear surface part of the toilet main body portion 4 formed below bottom portion 6*a* of the reservoir tank portion 206 and below rear wall portion 206*c*, and an attaching portion 222, to which the drive unit main body portion 18 is attached, is disposed on this rib 204*d*.

With respect to the affixing member 24, in an orientation wherein the longitudinal direction thereof extends in the up-down direction of the toilet main body portion 4, a pair of affixing screws 84, multiple washers 284*a*, and a pair of nuts 284*b* are respectively attached to the pair of attaching holes 86 on the affixing member 24 and the pair of attaching holes (not shown) on the attaching portion 222 of the toilet main body portion 204 rib 204*d*, thereby affixing the affixing member 24 to the toilet main body portion 204 rib 204*d*.

In addition, in the flush toilet apparatus 200 according to a second embodiment of the invention, when the drive unit main body portion 18 is affixed to the affixing member 24, with respect to the hook portion 88*b* on the drive unit main body portion 18 outside casing 88, after the second locking hole 98 on the affixing member 24 is selected and the hook is inserted, rotating the outside casing 88 by a predetermined angle around the rotary center axis line A2 of the rotary shaft 94 on the actuator 16 results in the outside casing 88 hook portion 88*b* lodging in the second locking hole 98 and locking.

Also, in a state wherein the drive unit main body portion 18 is attached to the attaching portion 222 of the toilet main body portion 204 through the affixing member 24, with respect to the operating member 20*b* for electrically powered operation on the drive unit main body portion side, after passing through the cut-out channel 66 on the rear wall portion 206*c* of the reservoir tank portion 206 and the cut-out channel 88*d* on the outside casing 88, respectively, the part P (see FIGS. 15 and 16) connected to the gear unit 78 of the drive unit main body portion 18 is essentially vertically connected to the drive unit main body portion 18. In addition, the wire 76 for electrically powered operation in the operating member 20*b* for electrically powered operation is movably linked to a portion of the outer perimeter area of the pulley 82 in the rotational tangent direction of the pulley 82 as it is wound onto the outside perimeter portion of the pulley 82 with the rotation of the pulley 82.

In a flush toilet apparatus 200 according to the second embodiment of the invention described above, with respect to the automatic flushing drive unit 14 which drives the discharge valve apparatus 8 inside the reservoir tank portion 206 placed on the rear side on the toilet main body portion 204, in a state wherein the drive unit main body portion 18 thereof is attached to the attaching portion 22 provided at the back surface side of the toilet main body portion 204, the drive unit main body portion 18 is disposed at the bottom of the reservoir tank portion 6 and on the rib 204*d* on the back surface side of the toilet main body portion 204, and is disposed in the vicinity of an area vertically below the discharge valve apparatus 8, therefore slack over the entire length of the elongated operating member 20 (20*a*, 20*b*) for electrically powered operation of drive unit 14 can be constrained.

Because of the presence of the affixing member 24 for affixing the drive unit main body portion 18 to the attaching portion 222 on the toilet main body portion 204 according to the toilet main body portion 204 or reservoir tank portion 206 type in an orientation wherein slack over the entire length of the operating member 20 (20*a*, 20*b*) for electrically powered operation is constrained, the drive unit main body portion 18 can be reliably affixed to the attaching portion 222 on the toilet main body portion 4 through this affixing member 24 in an orientation wherein slack over the entire length of the operating member 20 (20*a*, 20*b*) for electrically powered operation.

In addition, with respect to the operating member 20*b* for electrically powered operation on the drive unit main body portion side, the part P connected to the gear unit 78 passes through the cut-out channel 66 in the rear wall portion 206*c* of the reservoir tank portion 206, then passes through the cut-out channel 88*d* in the outside casing 88 of the drive unit main body portion 18 and is connected essentially perpendicularly to the drive unit main body portion 18, such that the entire length of the operating member 20 (20*a*, 20*b*) for electrically powered operation can be shortened, with the result that unnecessary bending of the operating member 20 (20*a*, 20*b*) for electrically powered operation caused by excessive length of the total length of the operating member 20 (20*a*, 20*b*) for electrically powered operation between the discharge valve apparatus 8 and the drive unit main body portion 18 can be constrained.

Because the projection-shaped tip portion 76*a* on the drive unit side of the wire 76 for electrically powered operation is linked to a portion of the outside perimeter area of the pulley 82 to be connected so that the wire 76 for electrically powered operation is able to move in the rotation tangent direction of the pulley 82 in the gear unit 78 when the actuator 16 is driven, the total length of each wire 70, 76 in each of the operating members 20*a*, 20*b* for electrically powered operation can be shortened, unnecessary bending of the wires 70, 76 caused by excessive total length of the wires 70, 76 between the discharge valve apparatus 8 and the drive unit main body portion 18 can be constrained.

As a result of these things, driving of the drive unit main body portion 18 actuator 16 enables the operating member 20 for electrically powered operation to accurately operate the opening and closing action of the discharge valve body 12 on the discharge valve apparatus 8, and variability in the amount of that operation can be constrained. A flush toilet apparatus 200 and drive unit 14 capable of appropriately performing the opening and closing action of the discharge valve body 12 in the discharge valve apparatus 8 can thus be provided.

Note that in the flush toilet apparatuses 1, 200 according to the above-described first and second embodiments we explained forms in which the attaching portions 22, 222, to which the drive unit main body portion 18 of drive unit 14 is attached through the affixing member 24, are themselves disposed on the back surface side of the toilet main body portions 4, 204 of the one piece-type flush toilets 2, 202, but without limitation to such forms, it is also acceptable with respect to the attaching portion of the drive unit main body portion to dispose these portions on the bottom surface side of the reservoir tank portion, so that the drive unit main body portion is disposed vertically below the discharge valve apparatus portion or close thereto, so that slack over the entire length of the operating member can be constrained.

Although the present invention has been explained with reference to specific, preferred embodiments, one of ordinary skill in the art will recognize that modifications and improvements can be made while remaining within the scope and spirit of the present invention. The scope of the present invention is determined solely by appended claims.

What is claimed is:

1. A flush toilet apparatus for flushing a toilet using flush water to discharge waste, comprising:

a toilet main body portion including a bowl portion for receiving waste;

a reservoir tank portion placed at a rear side on the toilet main body portion for storing flush water supplied to the toilet main body portion;

a direct-drive discharge valve apparatus portion placed inside the reservoir tank portion and including a valve body configured to open and close a discharge opening on the reservoir tank portion by up and down movement; and a drive unit portion configured to drive the direct-drive discharge valve apparatus portion so as to open and close the valve body;

wherein the drive unit portion includes a drive unit main body portion including an electrically powered drive portion configured to electrically drive the direct-drive discharge valve apparatus portion; and an elongated operating member connected to the direct-drive discharge valve apparatus portion and the drive unit main body portion, the elongated operating member being configured to operate opening and closing of the valve body by driving the electrically powered drive portion;

wherein the elongated operating member includes: a tube portion affixed at one end to the direct-drive discharge valve apparatus portion and affixed at an other end to the drive unit main body portion, and a wire portion inserted into the tube portion, with one end connected to the power drive portion and an other end connected to the valve body, so as to slide relative to the tube portion as a result of driving the power drive portion; and wherein an attaching portion to which the drive unit main body portion is attached, the attaching portion being provided on a back surface side of the toilet main body portion or a bottom surface side of the reservoir tank portion, and the drive unit main body portion is disposed outside of the reservoir tank portion and vertically below the direct-drive discharge valve apparatus portion while the drive unit main body portion is attached to the attaching portion, so that slack over an entire length of the elongated operating member is constrained.

2. The flush toilet apparatus according to claim 1, further comprising an affixing member for affixing the drive unit main body portion to the attaching portion of the toilet main body portion, in an orientation such that slack over the entire length of the elongated operating member is constrained.

3. The flush toilet apparatus according to claim 1, wherein the reservoir portion includes: a reservoir portion in which flush water is stored, a top end of the reservoir portion being opened, with the direct-drive discharge valve apparatus portion placed within the reservoir portion; and a lid body disposed at the top end of the reservoir portion; wherein the reservoir portion forms a rear wall portion adjacent to a rear side of the direct-drive discharge valve apparatus portion, and a hole or channel is formed on the rear wall portion or lid body above a shut-off water level inside the reservoir tank portion so that the elongated operating member can be inserted through an inside and an outside of the reservoir tank portion.

4. The flush toilet apparatus according to claim 3, wherein the elongated operating member is arranged such that a part thereof which is connected to the drive unit main body portion after passing through an insertable hole or channel at the rear wall portion of the reservoir portion is connected essentially perpendicularly to the drive unit main body portion.

5. The flush toilet apparatus according to claim 1, wherein the elongated operating member includes a first operating member connected at one end to the direct-drive discharge valve apparatus portion and a second operating member connected at one end to the drive unit main body portion; wherein the drive unit portion further includes a connecting means for connecting an other end of the first operating member and an other end of the second operating member in a state wherein respective lengths of the first operating member and the second operating member are adjusted in response to usage conditions.

6. The flush toilet apparatus according to claim 1, wherein the electrically powered drive portion in the drive unit main body portion includes an electrically powered drive source and a rotary mechanism portion rotated by the electrically powered drive source, and the wire portion of the elongated operating member moves in a rotation tangent direction of the rotary mechanism portion when the electrically powered drive portion is driven, so that one end is connected to the rotary mechanism portion to enable opening and closing of the valve body.

7. The flush toilet apparatus according to claim 1, wherein the reservoir tank portion is integrally formed on the rear side on the toilet main body portion.

8. The flush toilet apparatus according to claim 1, wherein a vertical width measurement in an up-down direction of the reservoir tank portion is set to be smaller than a left-right horizontal width dimension thereof.

9. A drive unit for a flush toilet apparatus for flushing a toilet using flush water to discharge waste, comprising:

a drive unit main body portion attached to a flush toilet apparatus including: a toilet main body portion including a bowl portion for receiving waste, a reservoir tank portion placed at a rear side on the toilet main body portion, the reservoir tank portion being configured to store flush water supplied to the toilet main body portion, and a direct-drive discharge valve apparatus portion placed inside the reservoir tank portion and including a valve body for opening and closing a discharge opening on the reservoir tank portion by up and down movement;

an electrically powered drive portion disposed on the drive unit main body portion for electrically powered driving of the direct-drive discharge valve apparatus portion; and an elongated operating member for connecting the direct-drive discharge valve apparatus portion and the drive unit main body portion and operating an opening and closing action of the valve body driven by the electrically powered drive portion;

wherein the elongated operating member includes: a tube portion affixed at one end to the direct-drive discharge valve apparatus portion and affixed at an other end to the drive unit main body portion, and a wire portion inserted into the tube portion, with one end connected to the power drive portion and an other end connected to the valve body, so as to slide relative to the tube portion as a result of driving the power drive portion; and wherein an attaching portion is provided on a back surface side of the toilet main body portion or a bottom surface side of the reservoir tank portion, on which the drive unit main body portion is attached, and the drive unit main body portion is disposed outside of the reservoir tank portion and vertically below the direct-drive discharge valve apparatus portion, so that when the drive unit main body portion is attached to the attaching portion, slack over an entire length of the elongated operating member is constrained.

10. The drive unit for the flush toilet apparatus according to claim 9, further comprising an affixing member for affixing the drive unit main body portion to the attaching portion of the toilet main body portion, in an orientation such that slack over the entire length of the elongated operating member is constrained.

11. The drive unit for the flush toilet apparatus according to claim 9, wherein the elongated operating member includes a first operating member connected at one end to the direct-drive discharge valve apparatus portion and a second operating member connected at one end to the drive unit main body portion; wherein the drive unit further includes a connecting means for connecting an other end of the first operating member and an other end of the second operating member in a state wherein respective lengths of the first operating member and the second operating member are adjusted in response to usage conditions.

* * * * *